US010577714B2

(12) United States Patent
Mukaiyama et al.

(10) Patent No.: US 10,577,714 B2
(45) Date of Patent: Mar. 3, 2020

(54) PLATING APPARATUS AND PLATING METHOD

(71) Applicant: EBARA CORPORATION, Tokyo (JP)

(72) Inventors: Yoshitaka Mukaiyama, Tokyo (JP); Jumpei Fujikata, Tokyo (JP); Hideharu Aoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 103 days.

(21) Appl. No.: 15/486,762

(22) Filed: Apr. 13, 2017

(65) Prior Publication Data

US 2017/0298531 A1 Oct. 19, 2017

(30) Foreign Application Priority Data

Apr. 14, 2016 (JP) ..... 2016-081246

(51) Int. Cl.

| | |
|---|---|
| ***C25D 17/28*** | (2006.01) |
| ***C25D 17/00*** | (2006.01) |
| ***C25D 17/06*** | (2006.01) |
| ***C25D 3/38*** | (2006.01) |
| ***C25D 7/12*** | (2006.01) |

(52) U.S. Cl.

CPC ..... *C25D 17/28* (2013.01); *C25D 3/38* (2013.01); *C25D 7/123* (2013.01); *C25D 17/001* (2013.01); *C25D 17/007* (2013.01); *C25D 17/06* (2013.01)

(58) Field of Classification Search

CPC ..... C25D 17/28; C25D 3/38; C25D 7/123; C25D 17/001; C25D 17/007; C25D 17/06; C25D 17/00; H01L 21/67775; H01L 21/67769; H01L 21/67379; H01L 21/67276; H01L 21/67745; H01L 22/26; H01L 21/67253; H01L 21/68757; H01L 21/67757; B65G 1/0407; B65G 2201/0297

See application file for complete search history.

(56) References Cited

U.S. PATENT DOCUMENTS

| | | | | |
|---|---|---|---|---|
| 2002/0027080 | A1 | 3/2002 | Yoshioka et al. | |
| 2002/0114686 | A1* | 8/2002 | Glynn | H01L 21/67379 414/292 |
| 2008/0069672 | A1* | 3/2008 | Ikehata | B65G 1/0407 414/283 |
| 2012/0100709 | A1* | 4/2012 | Minami | C25D 17/00 438/597 |
| 2016/0211157 | A1* | 7/2016 | Inoshima | H01L 21/67276 |

FOREIGN PATENT DOCUMENTS

| | | | | |
|---|---|---|---|---|
| JP | 3979847 | B2 | 9/2007 | |
| JP | 2012-112026 | A | 6/2012 | |
| JP | 5642517 | B | 12/2014 | |
| WO | WO2015030047 | * | 3/2015 | H01L 21/205 |

* cited by examiner

*Primary Examiner* — Xiuyu Tai

(74) *Attorney, Agent, or Firm* — BakerHostetler

(57) ABSTRACT

There are provided a plating apparatus and a plating method enabling continuous operation even while a stocker is taken out of the plating apparatus. The plating apparatus includes a plating treatment section performing plating on a substrate and a plurality of stockers configured to be able to store a holder configured to hold a substrate or an anode. At least one of the plurality of stockers is configured to be movable into and out of the plating apparatus.

15 Claims, 16 Drawing Sheets

PLATING APPARATUS AND PLATING METHOD

CROSS-REFERENCE TO RELATED APPLICATION

This application claims priority to Japanese Patent Application No. 2016-081246 filed on Apr. 14, 2016. The entire disclosure of Japanese Patent Application No. 2016-081246 filed on Apr. 14, 2016 is incorporated herein by reference in its entirety.

BACKGROUND OF THE INVENTION

Field of the Invention

The present invention relates to a plating apparatus and a plating method.

Description of the Related Art

There has been conventionally known a plating apparatus (for example, see Japanese Patent No. 3979847) which vertically places a substrate held by a substrate holder into a plating bath containing a plating solution and performs electroplating on the substrate. In such a plating apparatus, the substrate holder is stored in a stocker for storing the substrate holder before the operation of the apparatus starts. When the operation of the apparatus starts, the substrate holder is taken out of the stocker to hold a substrate such as a wafer to be processed. The substrate holder holding the substrate is transported by a substrate holder transport device to the plating bath and other treatment baths, where required plating processes are sequentially performed. For example, when a power feed failure is detected in a substrate holder, the substrate holder is returned to the stocker, and the use of the substrate holder is restricted until completion of maintenance.

In such a plating apparatus, the stocker storing the substrate holder is a part of the plating apparatus and integrated with the plating apparatus so as not to be separated from each other. Accordingly, the stocker itself storing the substrate holder cannot be taken out of the plating apparatus. Thus, when maintenance of the substrate holder stored in the stocker is needed, the substrate holder is taken out of the stocker manually or by a dedicated hoist. Alternatively, there has been used another method in which the substrate holder is transported from the stocker to a delivery bath or a service area accessible from outside in the plating apparatus and then taken out of the stocker manually or by a dedicated hoist when maintenance is needed.

In light of this, there has been proposed a plating apparatus (see Japanese Patent No. 5642517) having a wagon storing the substrate holder which can be taken out of the plating apparatus so as to be able to reduce the burden of taking such a substrate holder out of the plating apparatus and to easily perform maintenance on the substrate holder.

The plating apparatus disclosed in Japanese Patent No. 5642517 has a single stocker (wagon) only. Thus, when a stocker is taken out of the plating apparatus for maintenance, the plating apparatus has no stocker therein, which means that there is no place to return the substrate holder in use. In other words, in the state where the stocker is taken out of the plating apparatus, the continuous operation of the plating apparatus is disabled and thus the operation of the apparatus is forced to stop. Even if the stocker is configured to store an anode holder, a similar problem may arise.

SUMMARY OF THE INVENTION

In view of the above problems, the present invention has been made, and an object of the present invention is to provide a plating apparatus and a plating method enabling continuous operation even while the stocker is taken out of the plating apparatus.

An aspect of the present invention provides a plating apparatus. This plating apparatus includes a plating treatment section performing plating on a substrate; and a plurality of stockers configured to be able to store a holder configured to hold a substrate or an anode, wherein at least one of the plurality of stockers is configured to be movable into and out of the plating apparatus.

This aspect provides a plurality of stockers and at least one of the stockers can be taken out of the plating apparatus. Thus, a stocker storing a holder requiring maintenance can be taken out of the plating apparatus and maintenance can be performed on the holder. In addition, during maintenance, another stocker is in a state of being disposed in the plating apparatus. This enables continuous operation of the plating apparatus even while the holder is in maintenance. Thus, this aspect can increase the amount of production as compared with the conventional case where the plating apparatus is stopped. It has been found that the substrate holders and anode holders include some holders having no structural defect in the holder itself, but having a difference in the number of errors occurring in the plating process as the plating process continues, namely, some holders with a large number of errors and other holders with a small number of errors. This aspect provides a plurality of stockers in the plating apparatus. Therefore, for example, holders with a history of errors are stored in a first stocker and the other holders are stored in a second stocker, whereby the first stocker to be maintained can be moved out of the plating apparatus. Further, this aspect provides a plurality of stockers in the plating apparatus. Therefore, for example, the stocker taken out of the plating apparatus can store a holder with a specification different from the holders remaining in the plating apparatus. As a result, even if substrates with different specifications are mixed and processed, this aspect can continue the production without stopping the entire apparatus to replace the holders and thus can improve the productivity of the apparatus.

In an aspect of the present invention, the plating apparatus includes an opening portion for taking the stocker out of the plating apparatus; and the stocker has a partition wall on a side surface thereof, the partition wall covering at least a part of the opening portion so as to partition an inside of the plating apparatus and an outside of the plating apparatus.

According to this aspect, the partition wall of the stocker partitions the inside and the outside of the plating apparatus. Thus, when the stocker is disposed inside the plating apparatus, the operator can be prevented from entering the plating apparatus through the opening portion. Therefore, while the stocker is disposed inside the plating apparatus and the plating apparatus is operating, this aspect can prevent the operator from accidentally entering the plating apparatus and thus can ensure the safety of the operator. Note that in the plating apparatus disclosed in Japanese Patent No. 5642517, a shutter partitioning between the inside of the plating apparatus and the stocker is configured to be a spring-up type by a shutter rotation mechanism. For this reason, in the plating apparatus disclosed in Japanese Patent No. 5642517, if the shutter rotation mechanism fails, the shutter cannot be opened or closed, and thus the shutter remains open or closed. While the shutter remains closed, the operator cannot enter the plating apparatus, and while the shutter remains open, the operator can take the stocker (wagon) with less safety. In contrast to this, according to this aspect, a movable stocker has a partition wall, thus eliminating the need for a special mechanism to move the partition wall and simplifying the device configuration. In addition, this aspect can reduce the risk of device failure and can eliminate the need for space to install a mechanism such as the shutter rotation mechanism.

In an aspect of the present invention, the plating apparatus includes a rear partition wall disposed on an opposite side of the partition wall with the stocker interposed therebetween and configured so as to cover at least a part of the opening portion, the rear partition wall is configured to be movable with the stocker, and the plating apparatus includes a stopper stopping the rear partition wall moved to the opening portion.

According to this aspect, when the stocker is moved, the rear partition wall is moved; and when the rear partition wall is moved to the opening portion, the stopper stops the rear partition wall at the opening portion. Thus, even when the stocker is taken out of the apparatus, the rear partition wall stopping at the opening portion covers at least a part of the opening portion. Thus, this aspect can prevent the operator from accidentally entering the plating apparatus during maintenance of the holder stored in the stocker and can ensure the safety of the operator.

An aspect of the present invention includes a guide member for guiding the stocker into and out of the plating apparatus.

This aspect can facilitate the loading and unloading operation of the stocker.

In an aspect of the present invention, the guide member includes a sliding body slidably supporting the stocker.

According to this aspect, the sliding body slidably supports the stocker. Thus, when the stocker is moved into and out of the plating apparatus, less power is needed to load and unload the stocker and thus can facilitate the operation. In addition, the guide member includes a sliding body, thus eliminating the need to attach a moving caster or the like to the stocker.

In an aspect of the present invention, the plating apparatus includes a fixing member for fixing the stocker disposed in the plating apparatus.

This aspect can fix the stocker at an appropriate position when the stocker taken out of the plating apparatus is returned to the plating apparatus.

In an aspect of the present invention, the plating apparatus includes a stocker sensor detecting whether or not the stocker is present at a predetermined position inside the plating apparatus.

This aspect can detect whether or not the stocker is in a state of being taken out of the plating apparatus. Thus, the plating apparatus can recognize a usable stocker and can perform a plating process using only the stocker disposed in the plating apparatus without using the taken out stocker.

An aspect of the present invention includes an obstacle sensor detecting whether or not an obstacle is present in the opening portion.

This aspect can detect whether or not an obstacle is present in the opening portion. In the present plating apparatus, the obstacles that may be present in the opening portion are considered to include a partition wall, a stocker, a rear partition wall, and the like. Any one of the obstacles present in the opening portion prevents the operator from easily entering the plating apparatus. Thus, this aspect can ensure the safety of the operator by detecting whether or not an obstacle is present in the opening portion.

In an aspect of the present invention, the stocker includes a connecting portion configured to detachably connect the stocker to another stocker adjacent in a moving direction of the stocker.

According to this aspect, when a first stocker is moved out of the plating apparatus in the state where the first stocker is connected to a second stocker by the connecting portion, the second stocker can also be moved. Thus, the second stocker can be moved out of the plating apparatus together with the first stocker, and by releasing the connection when the second stocker is located at a position where the first stocker was present, the second stocker can also be moved to the position where the first stocker was present.

In an aspect of the present invention, the plating apparatus includes a support surface slidably supporting the stocker.

According to this aspect, the stocker is slidably supported by the support surface, and thus the stocker can be easily moved in any direction. Thus, for example, an extra stocker is disposed on the support surface, whereby one stocker is taken out of the plating apparatus, and then the extra stocker can be immediately stored in the plating apparatus. Thus, the substrate holder can be quickly interchanged.

In an aspect of the present invention, the plating apparatus includes a transport device configured to transport the holder and a control unit. The control unit is configured to select at least one of the plurality of stockers and instruct the transport device to store the holder in the selected stocker.

When an error occurs in a substrate holder or an anode holder or when a periodical maintenance time has come, the use of the holder needs to be stopped and the holder needs to be maintained. According to this aspect, for example, by selecting a stocker expected to store a holder needing its use to be stopped, the holder needing the use to be stopped can be stored in the stocker and taken out of the plating apparatus.

In an aspect of the present invention, the plating apparatus includes a transport device configured to transport the holder and a control unit. The control unit is configured to receive a signal indicating that an error occurred in the holder, select a stocker to store the holder in which the error occurred when the signal is received, and instruct the transport device to return at least the holder in which the error occurred to the selected stocker.

When an error occurs in a holder, this aspect can select a stocker expected to store the holder in which an error occurs, and store the holder in which the error occurred in the selected stocker to be taken out of the plating apparatus.

In an aspect of the present invention, the control unit is configured to control the plating treatment section and the transport device to perform plating on the substrate using the holder to be stored in a stocker other than the selected stocker.

This aspect performs a plating process using a holder to be stored in a stocker other than the selected stocker and thus can perform continuous operation even while the stocker is being taken out of the plating apparatus.

In an aspect of the present invention, the control unit is configured to determine whether or not the taken out stocker or a stocker different from the stocker is stored in the plating apparatus after the selected stocker is taken out of the plating apparatus, and control the plating treatment section and the transport device to perform plating on the substrate using the holder to be stored in all the stockers when the taken out stocker or a stocker different from the stocker is stored in the plating apparatus.

This aspect can perform a plating process using a holder stored in all the stockers including the stocker when the stocker is stored in the plating apparatus. Thus, after the stocker is returned to the plating apparatus, the plating process is performed using all the holders in the same way as normal. Thus, this aspect can prevent reduction in the amount of production of the plating apparatus.

In an aspect of the present invention, the plurality of stockers includes a maintenance-dedicated stocker to store a holder to be maintained, and the stocker to store the holder in which the error occurred is the maintenance-dedicated stocker.

According to this aspect, the holder in which an error occurred is stored in the maintenance-dedicated stocker. As used herein, the maintenance-dedicated stocker refers to a stocker which is not used at a normal plating process, but is used to store a holder to be maintained. Therefore, even if the maintenance-dedicated stocker is moved out of the plating apparatus for maintenance, the number of stockers for use in the normal plating process is unchanged. Thus, this aspect can maintain the number of usable stockers even during maintenance and thus can suppress reduction in the amount of production of the plating apparatus.

In an aspect of the present invention, the plating apparatus includes a moving device moving the stocker out of the plating apparatus, and the control unit is configured to determine whether or not the holder expected to be stored in the selected stocker is returned to the stocker and when the holder is returned to the selected stocker, control the moving device to take the selected stocker out of the plating apparatus.

This aspect can automatically unload the stocker when the holder is returned to the selected stocker, and thus can reduce the amount of operation of the operator.

In an aspect of the present invention, the moving device is configured to move the stocker into the plating apparatus.

This aspect can automatically store the stocker into the plating apparatus, and thus can reduce the amount of operation of the operator.

An aspect of the present invention provides a plating method using a plating apparatus including a plating treatment section performing plating on a substrate; and a plurality of stockers configured to be able to store a holder holding a substrate or an anode. This plating method includes a takeout step of moving at least one of the plurality of stockers out of the plating apparatus.

This aspect can take a stocker storing a holder requiring maintenance out of the plating apparatus and can perform maintenance on the holder. In addition, during maintenance, another stocker is in a state of being disposed in the plating apparatus. This enables continuous operation of the plating apparatus even while the holder is in maintenance. Thus, this aspect can increase the amount of production as compared with the conventional case where the plating apparatus is stopped. It has been found that the substrate holders and anode holders include some holders having no structural defect in the folder itself, but having a difference in the number of errors occurring in the plating process as the plating process continues, namely, some holders with a large number of errors and other holders with a small number of errors. This aspect provides a plurality of stockers in the plating apparatus. For example, holders with a history of errors are stored in a first stocker and the other holders are stored in a second stocker, whereby the first stocker to be maintained can be moved out of the plating apparatus. Further, this aspect provides a plurality of stockers in the plating apparatus. For example, a substrate holder for holding a substrate with a first specification can be stored in the first stocker, and the other substrate holders can be stored in the second stocker. Thus, even if substrates with different specifications are simultaneously or continuously transported to the plating apparatus, the plating process can be continued without stopping the apparatus. As a result, the plating process can be performed on the substrates with different specifications without reducing the throughput per unit time of the entire apparatus.

In an aspect of the present invention, the plating method includes a storage step of moving a stocker moved out of the plating apparatus or a stocker different from the stocker, into the plating apparatus.

This aspect can return the stocker moved out of the plating apparatus to the original position or can move a stocker different from the stocker moved out of the plating apparatus into the plating apparatus. Therefore, after the stocker is taken out of the plating apparatus for maintenance, the number of stockers can be returned to the original number. Note that when a stocker different from the stocker moved out of the plating apparatus is moved into the plating apparatus, the different stocker can be returned to the plating apparatus before the maintenance of the holder to be stored in the stocker moved out of the plating apparatus is completed. Therefore, this aspect does not reduce the number of stockers disposed in the plating apparatus during maintenance and thus can suppress reduction in the amount of production of the plating apparatus.

In an aspect of the present invention, the plating method includes a step of selecting at least one of the plurality of stockers and a step of returning a holder to the selected stocker. The takeout step includes a step of taking the selected stocker out of the plating apparatus.

When an error occurs in a substrate holder or an anode holder or when a periodical maintenance time has come, the use of the holder needs to be stopped and the holder needs to be maintained. According to this aspect, for example, by selecting a stocker expected to store a holder needing its use to be stopped, the holder needing the use to be stopped can be stored in the stocker and taken out of the plating apparatus.

In an aspect of the present invention, the plating method includes a step of detecting that an error occurs in a holder, a step of selecting a stocker to store a holder in which the error occurred, and a step of returning at least the holder in which the error occurred to the selected stocker. The takeout step includes a step of taking the selected stocker out of the plating apparatus.

When an error occurs in a holder, this aspect can select a stocker expected to store the holder in which the error occurs, and store the holder in which the error occurred in the stocker to be taken out of the plating apparatus.

In an aspect of the present invention, the plating method includes a step of performing plating on a substrate using a holder to be stored in a stocker other than the selected stocker.

This aspect performs a plating process using a holder to be stored in a stocker other than the selected stocker and thus can perform continuous operation even while the stocker is being taken out of the plating apparatus.

In an aspect of the present invention, the plating method includes a holder presence or absence determination step of determining whether or not the holder expected to be stored in the selected stocker is returned to the stocker, and the takeout step of taking the selected stocker out of the plating apparatus is executed when the holder is determined to have been returned to the selected stocker.

This aspect determines whether or not the holder is returned to the selected stocker, and thus can take the stocker out of the plating apparatus after the holder is surely returned to the stocker.

In an aspect of the present invention, the plating method includes a stocker presence or absence determination step determining whether or not the stocker taken out of the plating apparatus or a stocker different from the stocker is stored in the plating apparatus after the selected stocker is taken out of the plating apparatus, and a step of performing plating on the substrate using the holder to be stored in all the stockers when the stocker taken out of the plating apparatus or a stocker different from the stocker is stored in the plating apparatus.

This aspect can perform a plating process using the holders stored in all the stockers including the stocker when the stocker is stored in the plating apparatus. Thus, after the stocker is returned to the plating apparatus, the plating process is performed using all the holders in the same way as normal. Thus, this aspect can prevent reduction in the amount of production of the plating apparatus.

In an aspect of the present invention, the plurality of stockers includes a maintenance-dedicated stocker to store a holder to be maintained, and the stocker to store the holder in which the error occurred is the maintenance-dedicated stocker.

According to this aspect, a holder in which an error occurred is stored in a maintenance-dedicated stocker. As used herein, the maintenance-dedicated stocker refers to a stocker which is not used at a normal plating process, but is used to store only the holder in which an error occurred. Therefore, even if the maintenance-dedicated stocker is moved out of the plating apparatus for maintenance, the number of stockers for use in the normal plating process is unchanged. Thus, this aspect can maintain the number of usable stockers even during maintenance and thus can suppress reduction in the amount of production of the plating apparatus.

DETAILED DESCRIPTION OF THE PREFERRED EMBODIMENTS

First Embodiment

Figure 1:
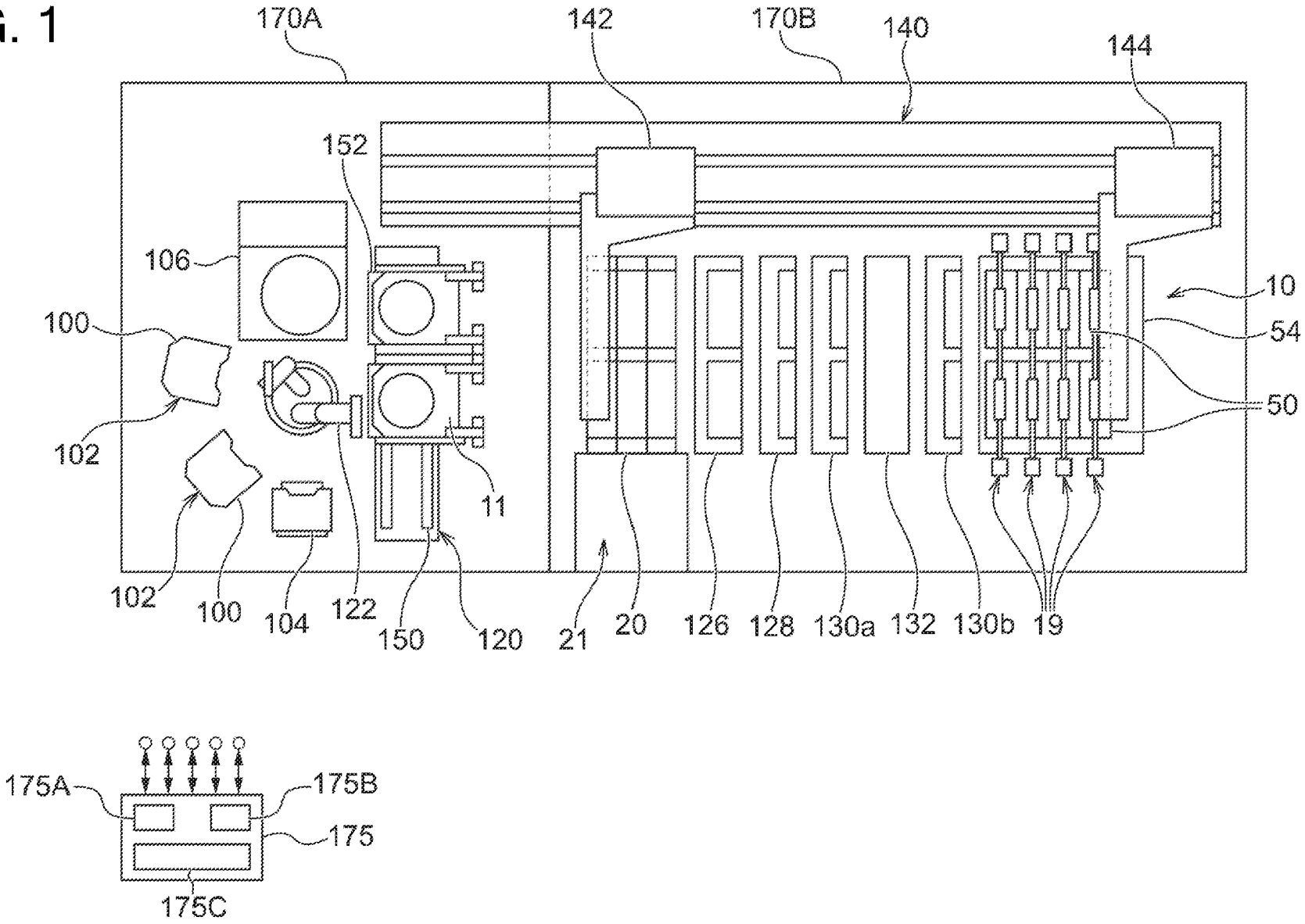
FIG. 1 is an overall layout view of a plating apparatus according to a first embodiment.

Hereinafter, a first embodiment of the present invention will be described with reference to the accompanying drawings. In the drawings described below, the same reference numerals or characters are assigned to the same or similar components, and the overlapping description is omitted. FIG. 1 is an overall layout view of a plating apparatus according to the first embodiment. As illustrated in FIG. 1, the plating apparatus is roughly divided into a loading/unloading section 170A which loads a substrate into a substrate holder 11 or unloads a substrate from the substrate holder 11; and a treatment section 170B which treats the substrate.

The loading/unloading section 170A includes two cassette tables 102, an aligner 104 which aligns the positions such as an orientation flat and a notch of a substrate in a predetermined direction, and a spin rinse dryer 106 which dries the substrate after plating process by rotating the substrate at high speed. The cassette table 102 mounts a cassette 100 storing a substrate such as a semiconductor wafer. The loading/unloading section 170A also includes a substrate attaching/detaching section 120 which is provided near the spin rinse dryer 106 and places the substrate holder 11 thereon to attach and detach the substrate. The loading/unloading section 170A also includes a substrate transport device 122 which is disposed at a center of these units 100, 104, 106, and 120, and includes transporting robots for transporting substrates among these units.

The substrate attaching/detaching section 120 includes a flat plate-like placement plate 152 slidable in the lateral direction along the rail 150. The two substrate holders 11 are horizontally placed in parallel on the placement plate 152. After a substrate is transferred between one substrate holder 11 and the substrate transport device 122, the placement plate 152 laterally slides, and the substrate is transferred between the other substrate holder 11 and the substrate transport device 122.

The treatment section 170B of the plating apparatus includes a plurality of stockers 20, a pre-wet bath 126, a pre-soak bath 128, a first cleaning bath 130*a*, a blow bath 132, a second cleaning bath 130*b*, and a plating bath 10 (corresponding to an example of the plating treatment section). In the stocker 20, the substrate holder 11 is stored and temporarily placed. Note that in the present description, the place in the plating apparatus where the stocker 20 is installed is referred to as a stocker installation section. Note also that in the present embodiment, the stocker 20 is configured to store the substrate holder 11, but may be configured to store an anode holder for use in the plating bath 10. The treatment section 170B of the plating apparatus also includes an opening portion 21 formed to load and unload the stocker 20 into and from the plating apparatus. In the pre-wet bath 126, the substrate is immersed in pure water. In the pre-soak bath 128, an oxide film is removed by etching from the surface of a conductive layer such as a seed layer formed on the surface of the substrate. In the first cleaning bath 130*a*, the substrate after pre-soaking is cleaned with a cleaning fluid (pure water, etc.,) together with the substrate holder 11. In the blow bath 132, the substrate after cleaning is drained. In the second cleaning bath 130*b*, the substrate after plating is cleaned with a cleaning fluid together with the substrate holder 11. The stocker 20, the pre-wet bath 126, the pre-soak bath 128, the first cleaning bath 130*a*, the blow bath 132, the second cleaning bath 130*b*, and the plating bath 10 are disposed in this order.

The plating bath 10 includes a plurality of plating cells 50 including, for example, an overflow bath 54. Each plating cell 50 has a substrate stored therein and each substrate is immersed in a plating solution therein and the substrate surface is subjected to plating such as copper plating. Here, the type of the plating solution is not particularly limited, but various plating solutions may be used depending on the application. For example, in the case of a plating solution for a through silicon via (TSV) plating process, available plating solutions are listed in the following Table 1. More specifically, the base solution for TSV may contain Cu, $H_2SO_4$, and Cl each having a concentration listed in Table 1, and the organic additives may include an additive A (suppressor), an additive B (accelerator), and an additive C (leveler) each having a concentration listed in Table 1.

TABLE 1

| Constituent | | | Concentrations |
|---|---|---|---|
| Base solution | Base solution for TSV | Cu | 50~70 g/L |
| | | H2SO4 | 40~60 g/L |
| | | Cl | 40~60 mg/L |
| Organic additives | Additive A for TSV (Suppressor) | | 4~8 mL/L |
| | Additive B for TSV (Accelerator) | | 0.4~1.0 mL/L |
| | Additive C for TSV (Leveler) | | 4~15 mL/L |

In addition, the plating solution may contain cobalt-tungsten-boron (CoWB), cobalt-tungsten-phosphide (CoWP), and other compounds for use in forming a metal film on the substrate surface having a Cu wiring. Further, the plating solution may contain CoWB or Ta (tantalum) compounds for use in forming a barrier film provided on the substrate surface or the surface of concave portions of the substrate before the Cu wiring is formed in order to prevent Cu from diffusing into an insulating film thereof.

The plating apparatus includes a substrate holder transport device 140 (corresponding to an example of the transport device) which uses, for example, a linear motor system and is located on a side of each of these devices to transport the substrate holder 11 together with the substrate to and from each of these devices. This substrate holder transport device 140 includes a first transporter 142 and a second transporter 144. The first transporter 142 is configured to transport the substrate holder 11 to and from the substrate attaching/detaching section 120, the stocker 20, the pre-wet bath 126, the pre-soak bath 128, the first cleaning bath 130*a*, and the blow bath 132. The second transporter 144 is configured to transport the substrate holder 11 to and from the first cleaning bath 130*a*, the second cleaning bath 130*b*, the blow bath 132, and the plating bath 10. In another embodiment, the plating apparatus may include only one of the first transporter 142 and the second transporter 144.

The overflow bath 54 has a paddle drive device 19 which is disposed on both sides thereof and drives a paddle which is located inside each of the plating cells 50 and serves as a stirring bar for agitating the plating solution in each of the plating cells 50.

The thus configured plating apparatus includes a controller 175 configured to control each of the aforementioned sections. The controller 175 may control the entire plating process system including a plurality of the plating apparatuses illustrated in FIG. 1. The controller 175 includes a memory 175B storing predetermined programs, a central processing unit (CPU) 175A executing the programs stored in the memory 175B, and a control unit 175C (corresponding to an example of the control unit) implemented when the CPU 175A executes the programs. The control unit 175C can perform, for example, a transport control of the substrate transport device 122, a transport control of the substrate holder transport device 140, a control of the plating current and plating time in the plating bath 10, and other controls. In addition, the controller 175 may be configured to communicate with an unillustrated higher-level controller controlling the plating apparatus and other related devices to exchange data to and from a database of the higher-level controller. Herein, the memory 175B stores various setting data and various programs such as a plating process program to be described later. The memory 175B may be a computer-readable ROM, RAM, hard disk, CD-ROM, DVD-ROM, and other known disk-shaped storage media such as a flexible disk.

Before the plating process, the substrate holder 11 is stored in the stocker 20. During the plating process, the substrate holder 11 is moved between the placement plate 152 of the substrate attaching/detaching section 120 and each bath by the substrate holder transport device 140. After the substrate is plated, the substrate holder 11 is stored again in the stocker 20. When the substrate is plated, the substrate held by the substrate holder 11 is vertically immersed in the plating solution stored in the plating cell 50 of the plating bath 10. In the state where the substrate is immersed in the plating solution, the plating solution is introduced from below the plating cell 50 and plating is performed while being overflowed into the overflow bath 54.

Each of the plating cells 50 constituting the plating bath 10 is configured to store one substrate holder holding one substrate and perform plating on the substrate. Each of the plating cells 50 preferably includes a conducting portion to the substrate holder 11, an anode held by an anode holder, the paddle drive device 19, and a shielding plate. The exposed surface of the anode held by the anode holder is formed concentrically with the substrate. The substrate held by the substrate holder 11 is treated with a processing fluid in each bath.

Figure 2:
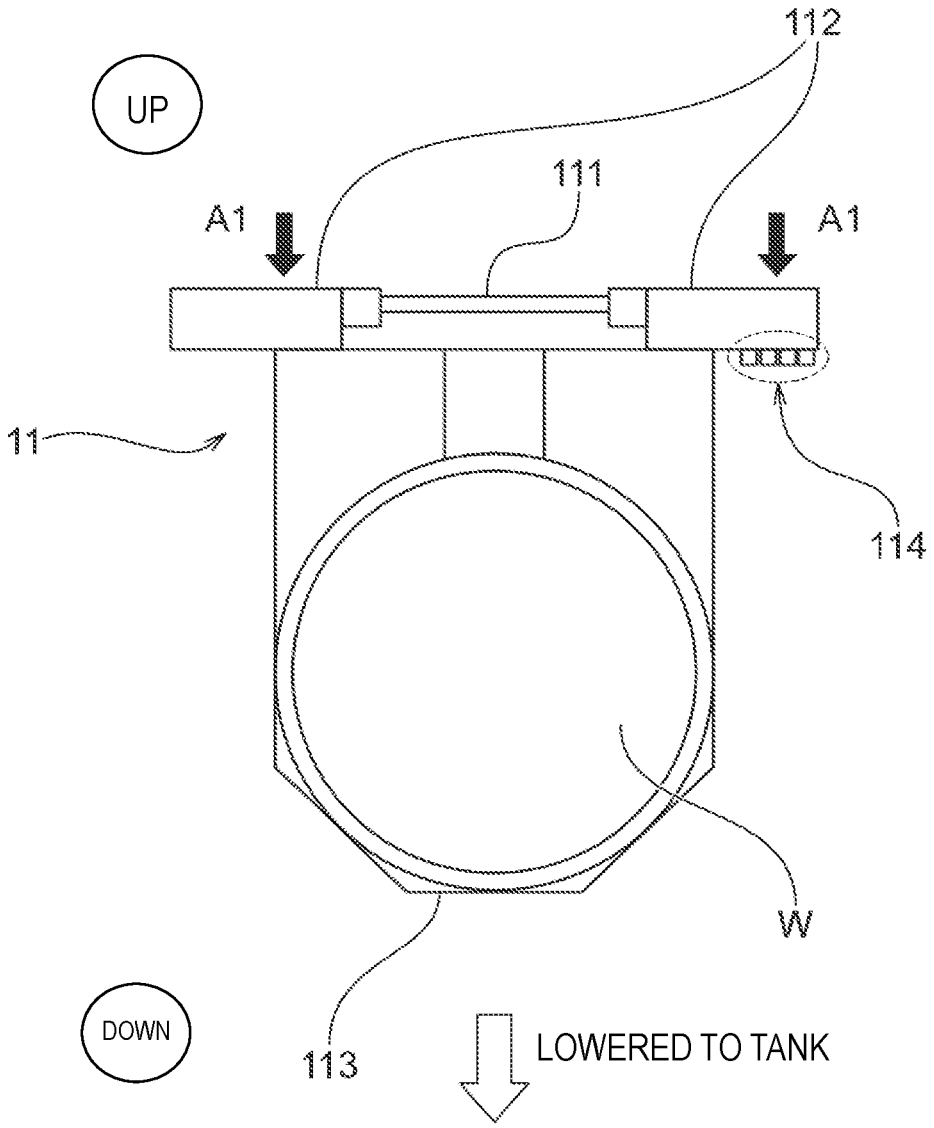
FIG. 2 is a schematic view illustrating an example of a substrate holder for use in the plating apparatus.

FIG. 2 is a schematic view illustrating an example of the substrate holder for use in the plating apparatus according to the present embodiment. As illustrated in FIG. 2, the substrate holder 11 has a handlebar 111 on one side thereof. The handlebar 111 is held by the substrate holder transport device 140 illustrated in FIG. 1. The handlebar 111 has a round bar shape so that the substrate holder 11 can be rotated when the posture thereof is changed from a vertical state to a horizontal state or from the horizontal state to the vertical state. The handlebar 111 is desirably made of stainless steel resistant to corrosion so as to prevent corrosion when a plating solution adheres thereto. Note that the stainless steel may not be able to withstand corrosion by the plating solution depending on the type and concentration of the plating solution. In this case, it is preferable to enhance the corrosion resistance by coating the surface of the stainless steel with chromium plating, TiC, or the like. Note that titanium having high corrosion resistance can be used for the handlebar 111, but titanium generally has a large frictional resistance on its surface, and thus needs finishing suitable for sliding.

In addition, a hanger portion 112 having a rectangular parallelepiped shape or a cubic shape is provided at both upper ends of the substrate holder 11. When the substrate holder 11 is disposed in each bath, the hanger portion 112 is disposed above a hanger receiving member of each bath, thereby to function as a support portion for suspending the substrate holder 11. Note that when the plating bath is an electroplating bath, a mutual contact between a power supply contact 114 provided at the hanger portion 112 and an electrical contact provided at the hanger receiving member causes an electric current to be supplied from an external power source to a to-be-plated surface of a substrate W. When the substrate holder 11 is suspended on the hanger receiving member, the power supply contact 114 is provided at a position not contacting the plating solution in the plating bath. When the substrate holder 11 is stored in the stocker 20, the hanger portion 112 is supported by a hanger receiving member 22 of the stocker 20 to be described later.

The hanger portion 112 may be designed so as to prevent the substrate holder 11 from swinging during movement when a force is applied by the substrate holder transport device 140 from the direction of arrows A1 illustrated in FIG. 2.

The substrate holder 11 illustrated in FIG. 2 holds the substrate W so as to seal the outer peripheral end portion of the substrate W and expose the to-be-plated surface. This prevents a plating solution from adhering to the outer peripheral end portion and the rear surface of the substrate W. In addition, the substrate holder 11 may include an unillustrated electrical contact which contacts the peripheral end portion of the to-be-plated surface of the substrate W to supply an electric current from an external power source to a seed layer on the substrate W via the power supply contact 114. As used herein, the "substrate holder" according to the present invention refers to a member for use in holding the substrate W before the plating process is performed by contacting the plating solution to the substrate W and transporting the substrate W before and after the plating process, and the specific configuration thereof is not limited to the example illustrated in FIG. 2.

Figure 3:
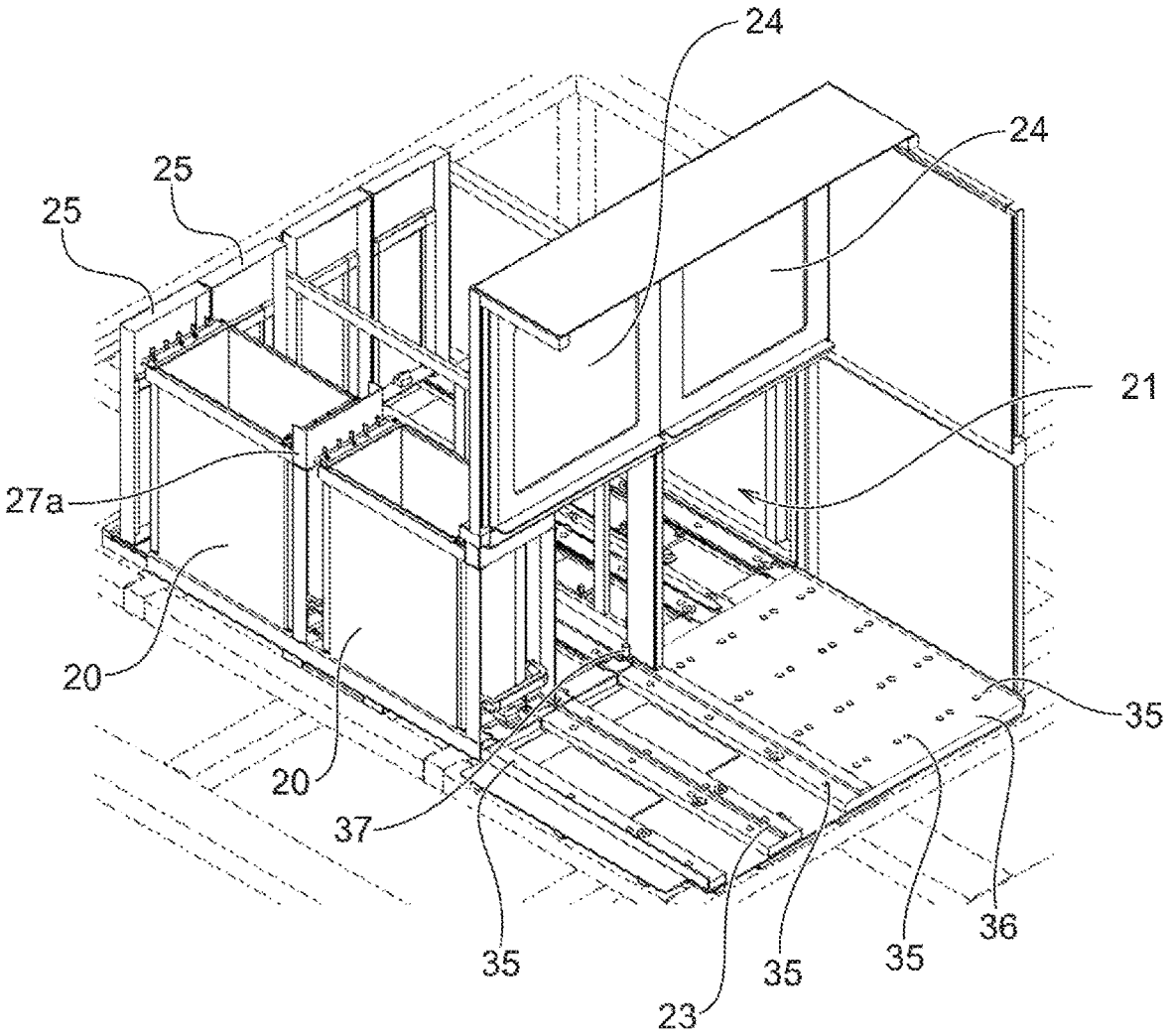
FIG. 3 is a perspective view of a stocker installation section in which stockers of the plating apparatus are disposed.

FIG. 3 is a perspective view of the stocker installation section in which stockers 20 of the plating apparatus illustrated in FIG. 1 are disposed. As described above, the plating apparatus according to the present embodiment includes a plurality of stockers 20. FIG. 3 illustrates two stockers 20. As illustrated in FIG. 1, the plating apparatus also includes the opening portion 21 for loading and unloading the stockers 20 into and from the plating apparatus. The plating apparatus further includes viewing windows 24 for the operator to view inside the plating apparatus from outside.

At least one of the plurality of stockers 20 according to the present embodiment is configured to be independently movable into and out of the plating apparatus. In other words, each of the plurality of stockers 20 can be independently moved into and out of the plating apparatus, or some of the plurality of stockers 20 are fixed inside the plating apparatus and each of the remaining stockers 20 can be independently moved into and out of the plating apparatus.

More specifically, the plating apparatus includes a rail 23 (corresponding to an example of the guide member) for guiding the stockers 20 to and from the plating apparatus. The upper surface of the rail 23 includes a plurality of sliding bodies 35 such as ball bearings for slidably supporting the stockers 20. The stockers 20 slide on the rail 23 while being supported by the sliding bodies 35 thereby to move into and out of the plating apparatus. When the stocker 20 is moved into and out of the plating apparatus, this configuration can facilitate the loading and unloading operation of the stocker 20. In addition, the rail 23 has sliding bodies 35, thus eliminating the need to attach moving casters or the like to the stocker 20.

Alternatively, the plating apparatus may include a support surface 36 slidably supporting the stockers 20. The upper surface of the support surface 36 includes a plurality of sliding bodies 35 slidably supporting the stockers 20. The stockers 20 disposed on the support surface 36 slide on the support surface 36 while being supported by the sliding bodies 35 thereby to move horizontally in any direction. Thus, for example, an extra stocker 20 is disposed on the support surface 36, whereby immediately after a first stocker 20 is taken out of the plating apparatus, the extra stocker 20 can be stored in the plating apparatus. Thus, the substrate holder 11 can be quickly interchanged.

The front side of the stocker 20 includes a partition wall member 27*a* configured to cover at least a part of the opening portion 21. The structure of the partition wall member 27*a* will be described in detail later. In addition, the plating apparatus includes rear partition walls 25 each disposed on a side opposite to the opening portion 21 of the stocker 20, namely, on a side opposite to the partition wall member 27*a* with the stocker 20 therebetween. The rear partition walls 25 are configured to be movable together with the stockers 20 and configured to cover at least a part of the opening portion 21. The plating apparatus includes a stopper 37 which is provided near the rail 23 to stop the rear partition wall 25 moved to the opening portion 21 near the opening portion 21. The stopper 37 is configured to contact a part of the rear partition wall 25 moved to the opening portion 21. This configuration prevents the rear partition wall 25 from moving beyond the stopper 37 out of the plating apparatus. Note that the stopper 37 is configured not to contact the stocker 20 and does not interfere with the movement of the stocker 20 into and out of the plating apparatus. In addition, the stopper 37 may be located at any position enabling the rear partition wall 25 moved to the opening portion 21 to stop and not interfering with the movement of the stocker 20. According to the present embodiment, when the stocker 20 is taken out, at least a part of the opening portion 21 is covered with the rear partition wall 25. Thus, the present embodiment can prevent the operator from accidentally entering the plating apparatus during maintenance of the substrate holder 11 stored in the stocker 20 and thus can ensure the safety of the operator.

Figure 4A:
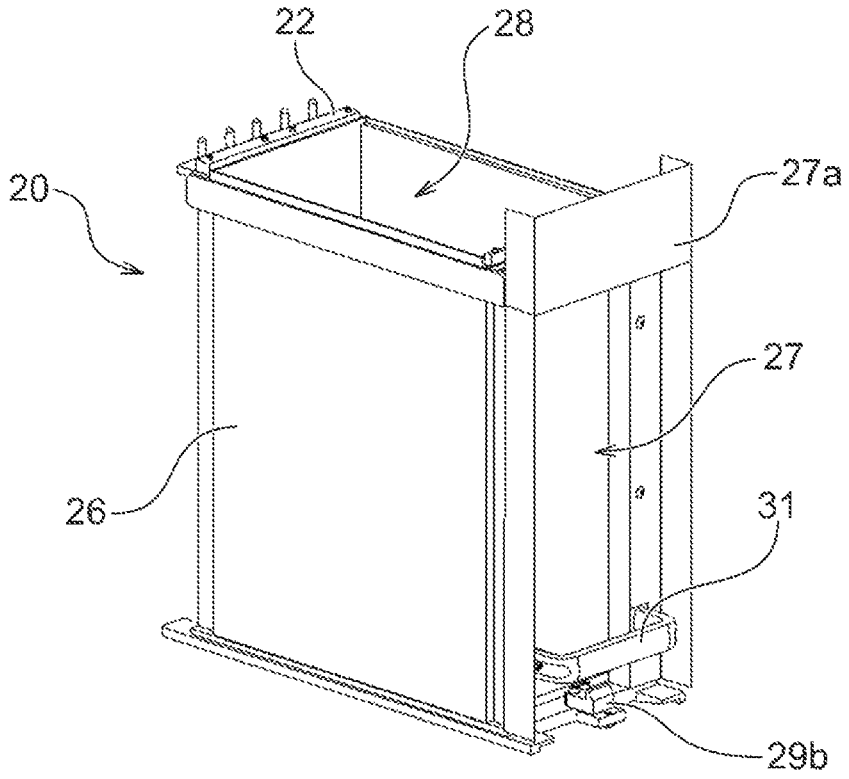
FIG. 4A is a front perspective view of a stocker.
Figure 4B:
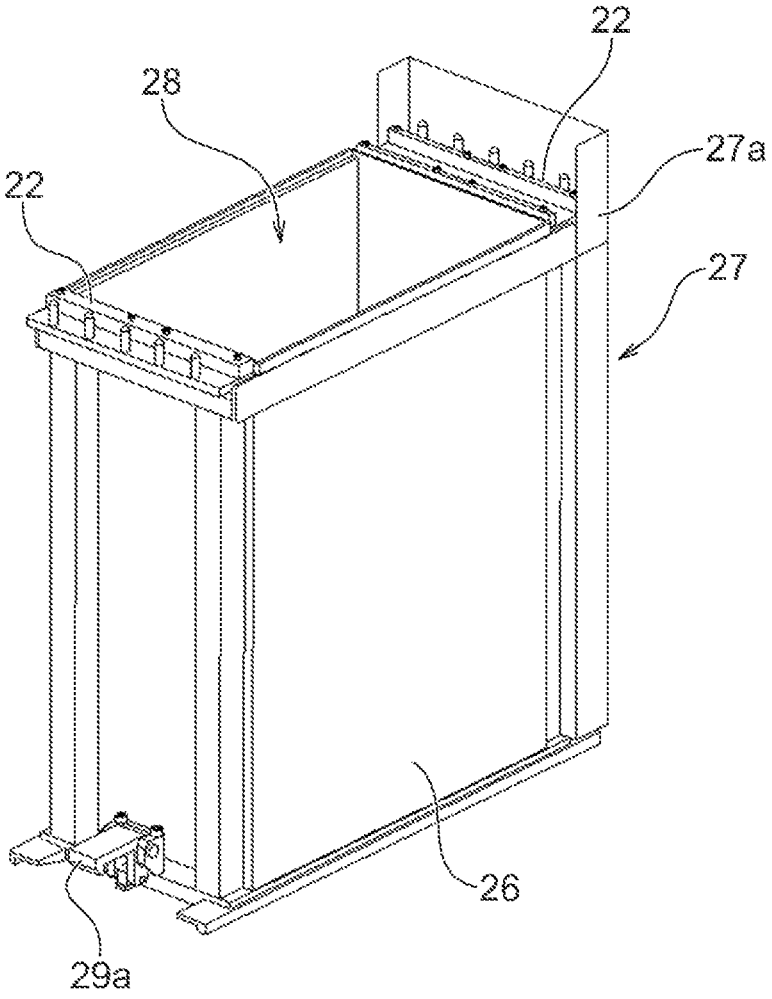
FIG. 4B is a rear perspective view of the stocker.
Figure 4C:
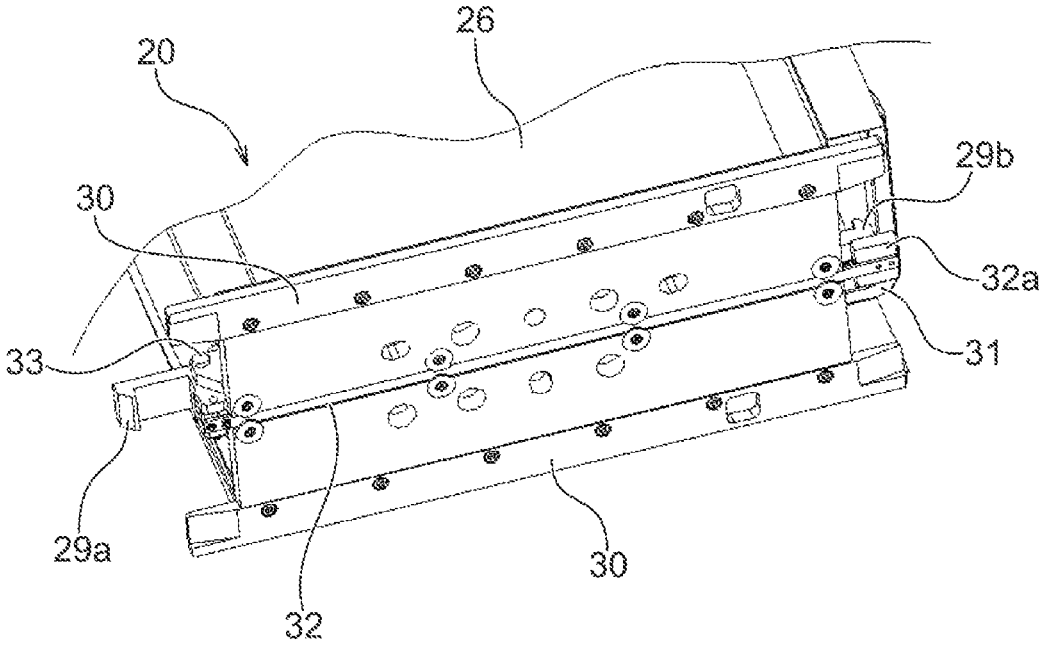
FIG. 4C is a bottom perspective view of the stocker.

Now, the description will focus on the detail of the stocker 20. FIG. 4A is a front perspective view of the stocker 20. FIG. 4B is a rear perspective view of the stocker 20. FIG. 4C is a bottom perspective view of the stocker 20. In the present description, the front of the stocker 20 refers to the side facing the opening portion 21 in the state where the stocker 20 is disposed in the plating apparatus, while the word "rear" refers to the opposite side. As illustrated in FIGS. 4A and 4B, the stocker 20 includes a substantially box-like stocker body 26 having an opening 28 storing the substrate holder 11. The stocker 20 includes a hanger receiving member 22 supporting the hanger portion 112 of the substrate holder 11 stored in the stocker body 26 from below. The front portion of the stocker body 26 includes a handle 31. When the stocker 20 is manually moved, the operator can operate the stocker 20 by grasping the handle 31.

In addition, the stocker 20 includes a partition wall member 27*a* extending upward from the front of the stocker body 26. The partition wall member 27*a* and the front of the stocker body 26 constitute the partition wall 27. The partition wall 27 is configured to cover at least a part of the opening portion 21 illustrated in FIG. 3, and partition the inside and the outside of the plating apparatus in the state where the stocker 20 is disposed in the plating apparatus. The configuration of the partition wall 27 is not limited to the one illustrated in FIGS. 4A and 4B, but may be any configuration as long as the configuration can cover at least a part of the opening portion 21. When the stocker 20 is disposed in the plating apparatus, the partition wall 27 of the stocker 20 can prevent the operator from entering the plating apparatus through the opening portion 21. Therefore, while the plating apparatus is operating in the state where the stocker 20 is disposed in the plating apparatus, this configuration can prevent the operator from accidentally entering the plating apparatus and can ensure the safety of the operator. In the present embodiment, the movable stocker 20 includes the partition wall 27, thus eliminating the need for a special mechanism to move the partition wall 27 and simplifying the device configuration. In addition, the present embodiment can reduce the failure risk of the plating apparatus and can eliminate the need for space to install a mechanism to move the partition wall 27.

As illustrated in FIG. 4C, the stocker 20 includes a slide portion 30 disposed on the bottom portion of the stocker body 26 and sliding on the rail 23 or the support surface 36 illustrated in FIG. 3. As illustrated in FIGS. 4A to 4C, the stocker 20 includes a locking part 29*a* and a locked part 29*b* each having a hooked tip and disposed on a pair of sides of the stocker 20. The locking part 29*a* of the stocker 20 is detachably engaged with the locked part 29*b* of another stocker 20 adjacent in a moving direction of the stocker 20. Therefore, the locking part 29*a* and the locked part 29*b* constitute the connecting portion configured to detachably connect the stocker 20 to another stocker 20 adjacent in the moving direction of the stocker 20.

As illustrated in FIG. 4C, the stocker 20 extends from the front side of the stocker 20 to the rear side thereof and includes an operation bar 32 connected to an end portion of the locking part 29*a* and disposed on the bottom surface thereof. The operation bar 32 is configured to be movable in its longitudinal direction (axial direction) and includes an operation end portion 32*a* disposed on the front side of the stocker 20. When the operator pushes the operation end portion 32*a* in the axial direction of the operation bar 32, the operation bar 32 moves in the axial direction. In addition, the stocker 20 includes a support shaft 33 rotatably supporting the locking part 29*a*.

Note that as described above, the plating apparatus of the present embodiment includes a plurality of stockers 20 and at least one of the stockers 20 is configured to be independently movable into and out of the plating apparatus. Hereinbefore, the stocker 20 illustrated in FIGS. 4A to 4C has been described to include a single stocker body 26. In other words, the stocker 20 illustrated in FIGS. 4A to 4C has been described to include a single storage portion storing the substrate holder 11 or the anode holder. However, without being limited to this, the stocker 20 may include a plurality of stocker bodies 26. In short, in the present description, the word "stocker" refers to a unit having one or more storage portions storing the substrate holder 11 or the anode holder. Accordingly, a plurality of stockers 20 constituting such a unit is provided in the plating apparatus of the present embodiment and at least one of the stockers 20 is configured to be movable into and out of the plating apparatus.

Figure 5:
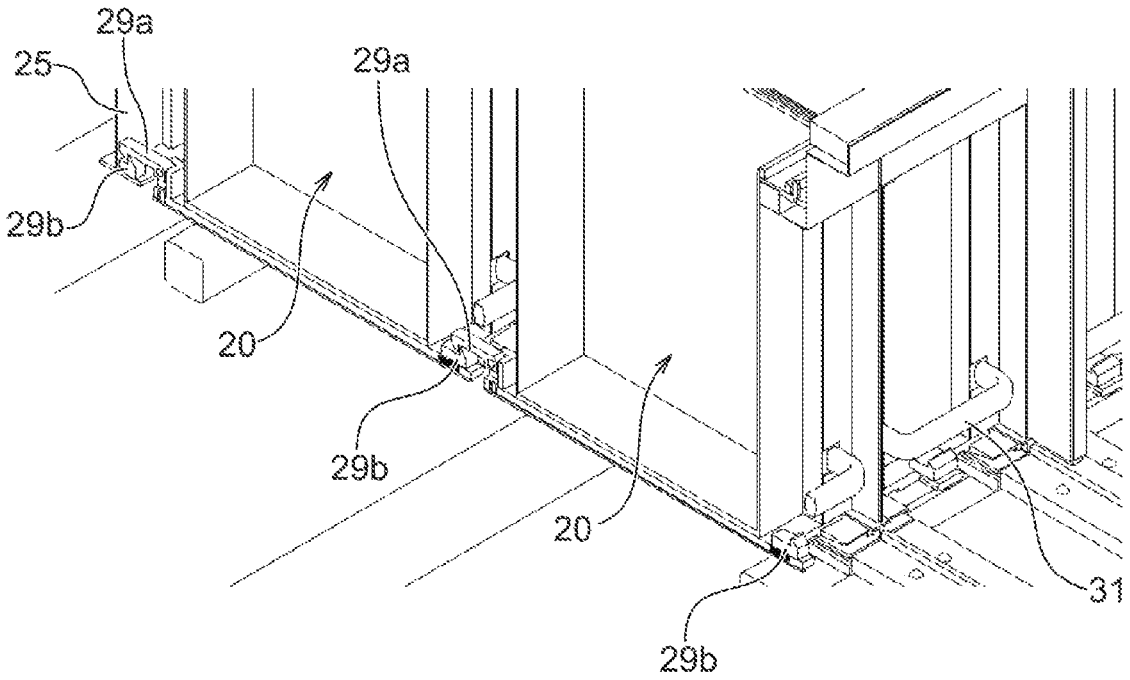
FIG. 5 is a partial perspective view illustrating a state in which a stocker is connected to another stocker.
Figure 6A:
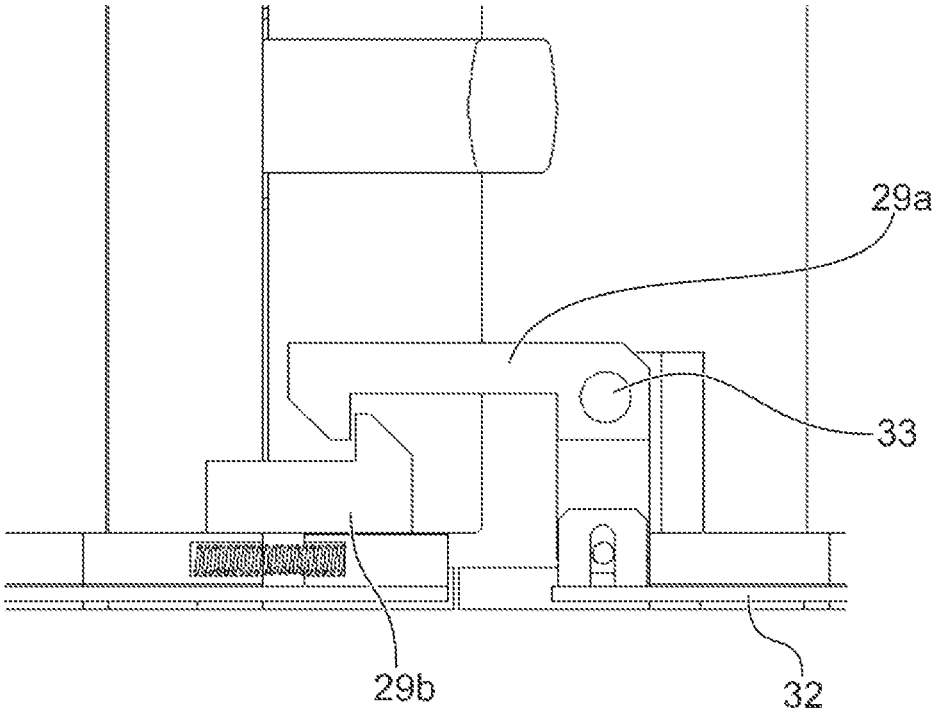
FIG. 6A is a side view of a connecting portion illustrating a state in which a stocker is connected to another stocker.
Figure 6B:
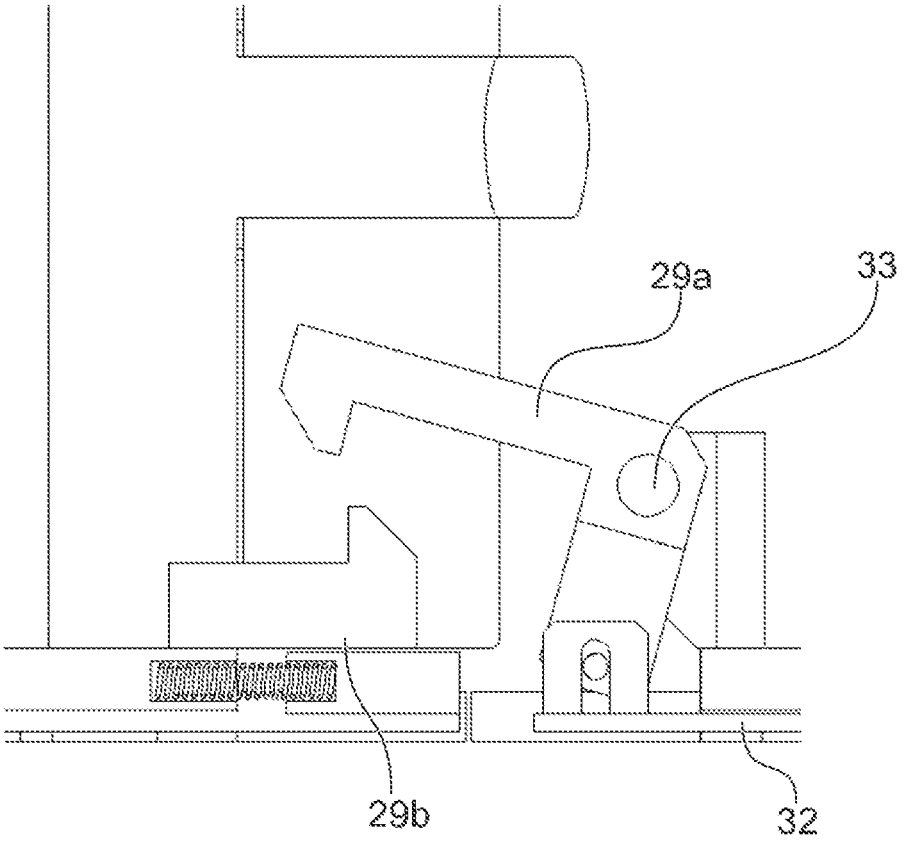
FIG. 6B is a side view of the connecting portion illustrating a state in which the connection between a stocker and another stocker is released.

Then, the description will move on to the detail of a connection structure of the stocker 20. FIG. 5 is a partial perspective view illustrating a state in which the stocker 20 is connected to another stocker 20. FIG. 6A is a side view of a connecting portion illustrating the state in which the stocker 20 is connected to another stocker 20. FIG. 6B is a side view of the connecting portion illustrating the state in which the connection between the stocker 20 and another stocker 20 is released. As illustrated in FIG. 5, the locking part 29*a* of a stocker 20 near the opening portion 21 (see FIG. 3) is engaged with the locked part 29*b* of an adjacent stocker 20. The rear partition wall 25 has the same locked part 29*b* as that of the stocker 20 and is engaged with the locking part 29*a* of the adjacent stocker 20. As a result, the two stockers 20 and the rear partition wall 25 are connected in a row.

As illustrated in FIG. 6A, in the state in which the stocker 20 is connected to another stocker 20, the hooked tip of the locking part 29*a* is engaged with the hooked tip of the locked part 29*b*. Although not illustrated herein, in the state in which the stocker 20 is connected to the rear partition wall 25, the hooked tip of the locking part 29*a* is engaged with the hooked tip of the locked part 29*b* in the same way as above.

When the operation end portion 32*a* of the operation bar 32 illustrated in FIG. 4C is pushed in the axial direction of the operation bar 32, the locking part 29*a* rotates around the support shaft 33 to raise the hooked tip of the locking part 29*a* as illustrated in FIG. 6B. As a result, the engagement between the locking part 29*a* and the locked part 29*b* is released and the connection between the stocker 20 and another stocker 20 or the rear partition wall 25 is released.

As illustrated in FIGS. 5, 6A, and 6B, a first stocker 20 is detachably connected to a second stocker 20. Thus, the first stocker 20 can be moved together with the second stocker 20 out of the plating apparatus, or by releasing the connection when the second stocker 20 is located at the position where the first stocker 20 was present, the second stocker 20 can be moved to the position where the first stocker 20 was present.

Figure 7:
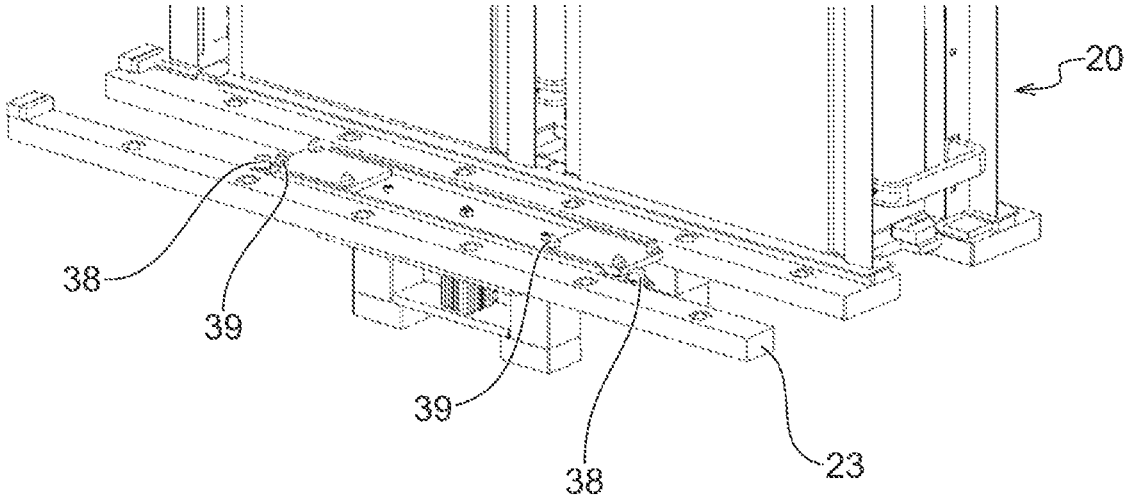
FIG. 7 is an enlarged perspective view of an installation surface of the stocker installation section.

Now, the description will move on to the configuration for detecting that the stocker 20 is disposed inside the plating apparatus. FIG. 7 is an enlarged perspective view of the installation surface of the stocker installation section. As described above, according to the present embodiment, at least one of the plurality of stockers 20 is configured to be independently movable into and out of the plating apparatus. For this reason, when the stocker 20 is taken out during operation of the plating apparatus, if the controller 175 of the plating apparatus is not notified that the stocker 20 has been taken out, the plating apparatus may continue operation assuming that the stocker 20 is present, resulting that there is a possibility that the substrate holder 11 is accidentally transported. Therefore, the plating apparatus can preferably detect whether or not the stocker 20 is present in the stocker installation section inside the plating apparatus. In light of this, the present embodiment provides a stocker sensor 38 on the installation surface of the stocker installation section. The stocker sensor 38 can detect whether or not the stocker 20 is present in a predetermined position inside the plating apparatus. In addition, the stocker sensor 38 is configured to transmit the detection result to the control unit 175C illustrated in FIG. 1. The control unit 175C performs transport control and the like on the substrate holder transport device 140 based on the received detection result. Thus, the plating apparatus can recognize the usable stocker 20 and can perform a plating process using only the stocker 20 disposed in the plating apparatus without using the taken out stocker 20.

Even if it is detected that the stocker 20 is present in the plating apparatus, but the stocker 20 is installed shifted from a desired position, there is a possibility that the substrate holder transport device 140 illustrated in FIG. 1 cannot take the substrate holder 11 out of the stocker 20 or store the substrate holder 11 in the stocker 20. Therefore, the stocker 20 is preferably fixed in a state of being installed in a desired position (stocker installation section) inside the plating apparatus. In light of this, the present embodiment provides a fixing pin 39 (corresponding to an example of the fixing member) for fixing the stocker 20 to the installation surface of the stocker installation section. The fixing pin 39 is configured to be vertically movable and to be inserted into a hole provided in the bottom surface of the stocker 20. When the stocker sensor 38 detects that the stocker 20 is present in the plating apparatus, the fixing pin 39 rises and is inserted into a hole provided in the bottom surface of the stocker 20, resulting in that the position of the stocker 20 is fixed. Thus, when the stocker 20 taken out of the plating apparatus is returned to the plating apparatus, the stocker 20 can be fixed to an appropriate position. Note that the fixing pin 39 is preferably formed in a tapered shape so that its tip becomes narrower. In this case, even if the stocker 20 disposed in the plating apparatus is slightly shifted from the desired position, the tip of the tapered fixing pin 39 can guide the stocker 20 to the desired position when the stocker 20 is fixed by the fixing pin 39.

Figure 8:
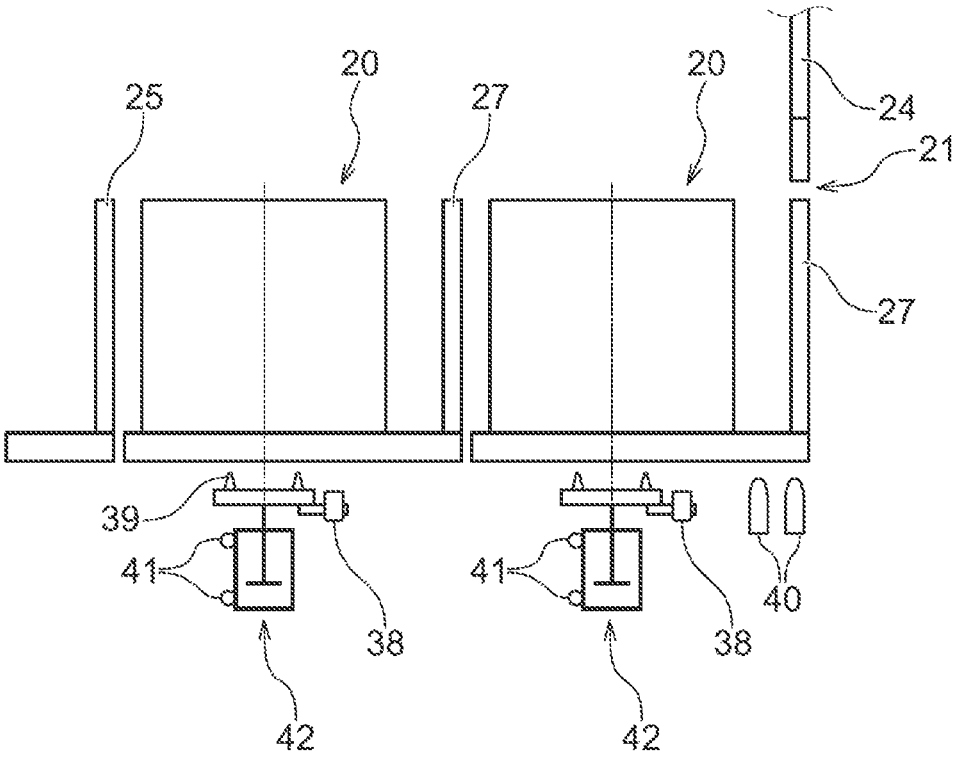
FIG. 8 is a schematic side view of the stocker installation section.

FIG. 8 is a schematic side view of the stocker installation section. As illustrated in the Figure, the plating apparatus includes a drive mechanism 42 such as a piston-cylinder mechanism to vertically move the fixing pin 39. The drive mechanism 42 includes a position sensor 41 detecting the position of the fixing pin 39. Even if the stocker sensor 38 detects that the stocker 20 is disposed in the plating apparatus, if the stocker 20 is installed shifted from the desired position, there is a possibility that the fixing pin 39 cannot be inserted into the hole provided in the bottom portion of the stocker 20. In this case, even if the fixing pin 39 is raised, the fixing pin 39 contacts the bottom surface of the stocker 20, and thus the position of the fixing pin 39 cannot be raised to the fixed position. When the fixing pin 39 is raised by the drive mechanism 42, if the position sensor 41 detects that the position of the fixing pin 39 is not raised to the fixed position (for example, uppermost position), then the position sensor 41 can transmit the detection result to the control unit 175C. When the control unit 175C receives this detection result, the control unit 175C determines that the stocker 20 is not disposed in the desired position and can issue a warning to the operator through a device such as a display or a speaker.

In addition, the plating apparatus includes an obstacle sensor 40 which is provided near the opening portion 21 and detects whether or not an obstacle is present in the opening portion 21. In the present plating apparatus, the obstacles that may be present in the opening portion 21 are considered to be the partition wall 27, the stocker 20, the rear partition wall 25, and the like. If any of the obstacles is present in the opening portion 21, the operator cannot easily enter the plating apparatus. Therefore, the safety of the operator can be ensured by detecting whether or not an obstacle is present in the opening portion 21. Note that the stocker 20 of the present embodiment includes a mutually connected structure and thus may have a small gap formed in the connecting portion. If only one obstacle sensor 40 is provided and the obstacle sensor 40 detects such a small gap, the obstacle sensor 40 may misdetect that no obstacle is present in the opening portion 21 though the stocker 20 is present in the opening portion 21. It is related to the safety of the operator whether or not an obstacle is present in the opening portion 21, namely, whether or not the operator is in a state capable of entering the plating apparatus from the opening portion 21. Thus, misdetection is preferably reduced as much as possible. For this reason, as illustrated in FIG. 8, two or more obstacle sensors 40 are preferably provided on the installation surface of the stocker installation section to reduce misdetection.

Then, the description will move on to an example of a process of taking the stocker 20 out of the plating apparatus. FIGS. 9A to 9D are a view illustrating the process of taking the stockers 20 out of the plating apparatus. In the example illustrated in FIGS. 9A to 9D, the plating apparatus includes a stocker moving device 45 (corresponding to an example of the moving device). In response to a command from the control unit 175C, the stocker moving device 45 moves the stocker 20 out of the plating apparatus or into the plating apparatus. The stocker moving device 45 include an actuator configured to move, for example, the rear partition wall 25. The means of automatically moving the stocker 20 is not limited to the stocker moving device 45, but a drive roller or the like may be provided on the installation surface of the stocker installation section and may be configured to transport the stocker 20 or the stocker 20 may be configured to move freely. Alternatively, the operator may manually load and unload the stocker 20 without using the stocker moving device 45.

Figure 9A:
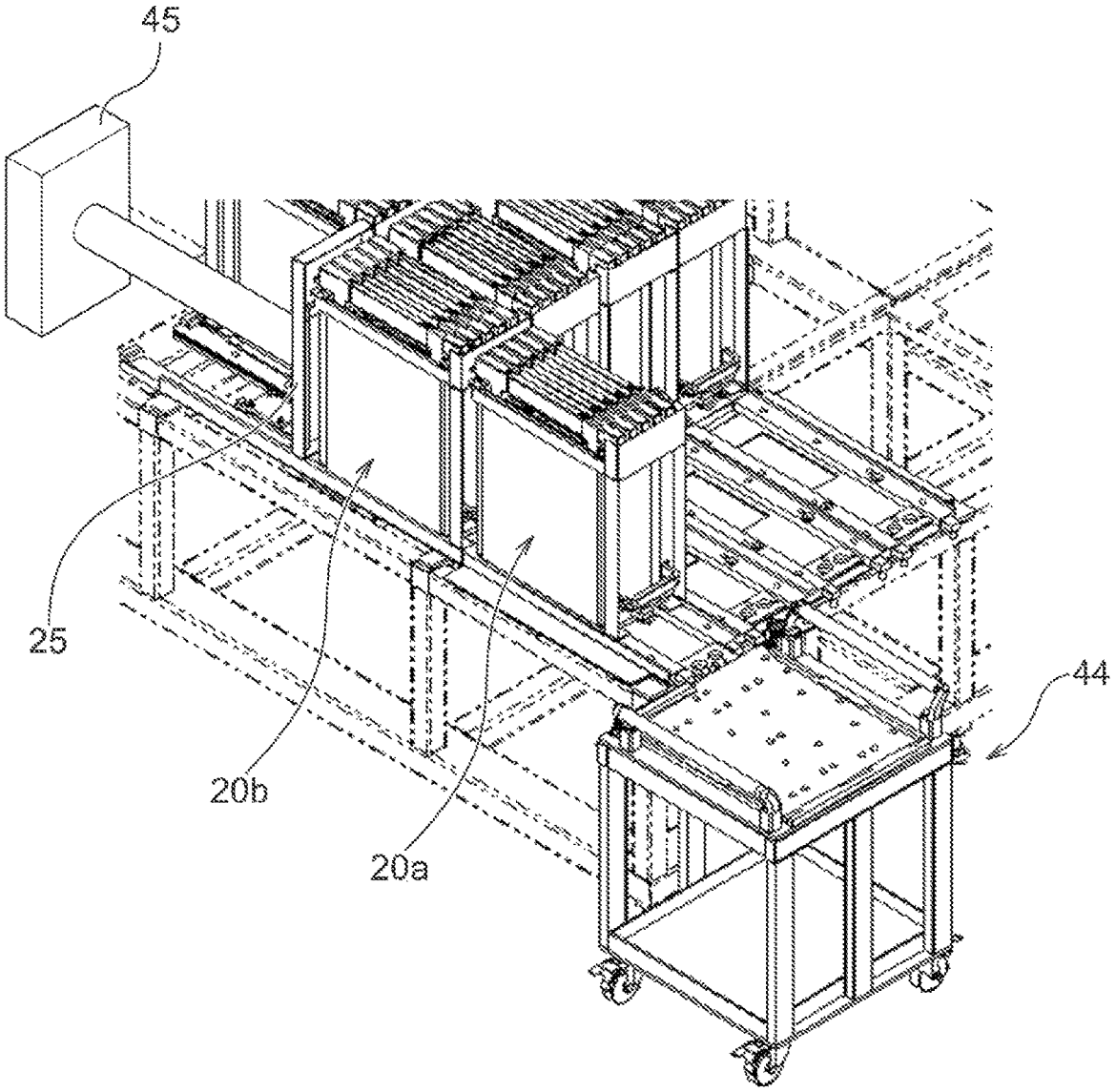
FIG. 9A is a view illustrating a process of taking stockers out of the plating apparatus.
Figure 9B:
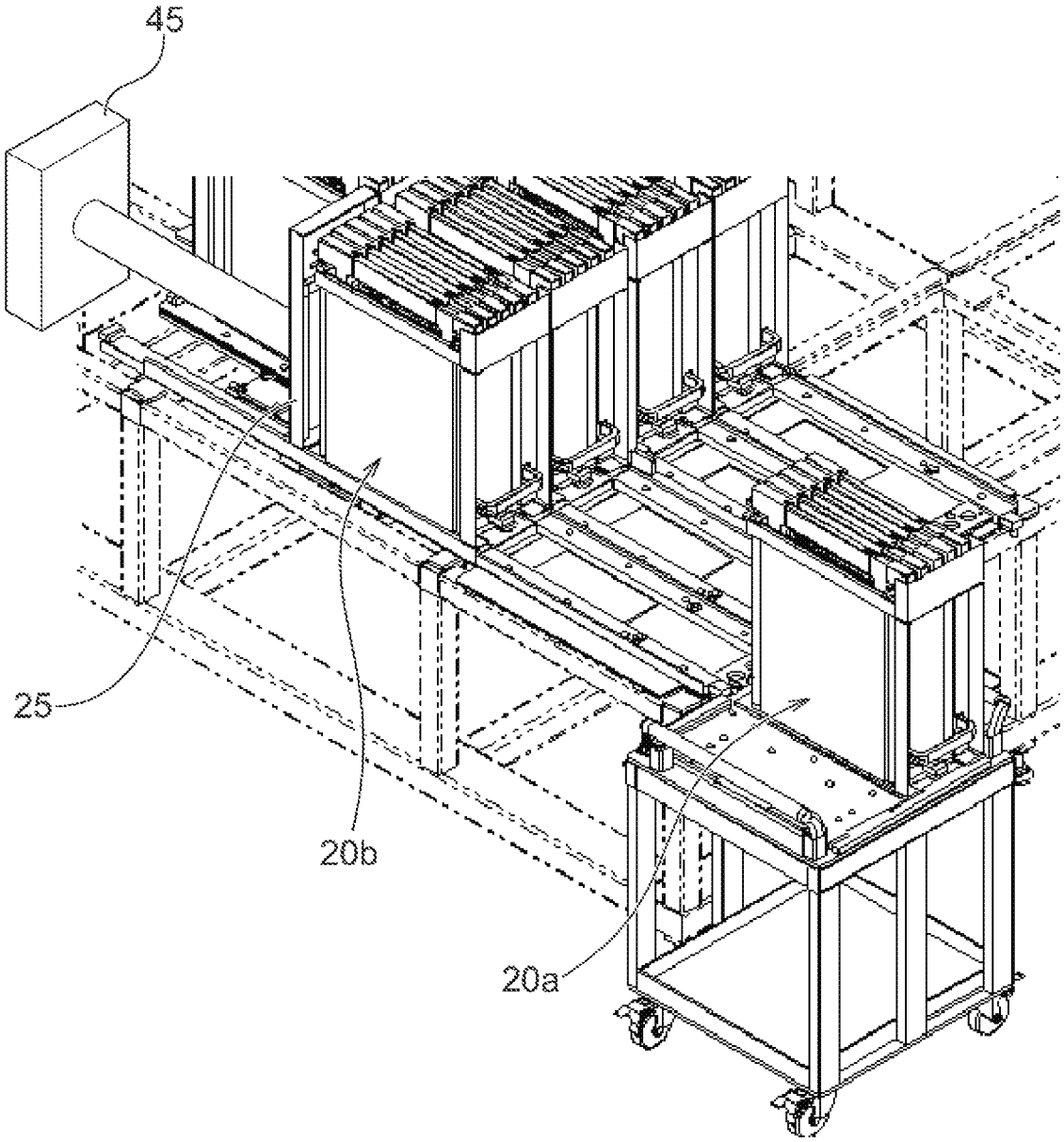
FIG. 9B is a view illustrating a process of taking stockers out of the plating apparatus.

As illustrated in FIG. 9A, first, a cart 44 for placing the taken out stocker 20 is disposed to be adjacent to the plating apparatus. Then, the stocker moving device 45 pushes the rear partition wall 25 to push the connected two stockers 20*a* and 20*b* out of the plating apparatus. At this time, only one stocker 20*a* is located outside the opening portion 21 (unillustrated). In this state, the connection between the stocker 20*a* and the stocker 20*b* is released, and only the stocker 20*a* is placed on the cart 44 as illustrated in FIG. 9B.

Figure 9C:
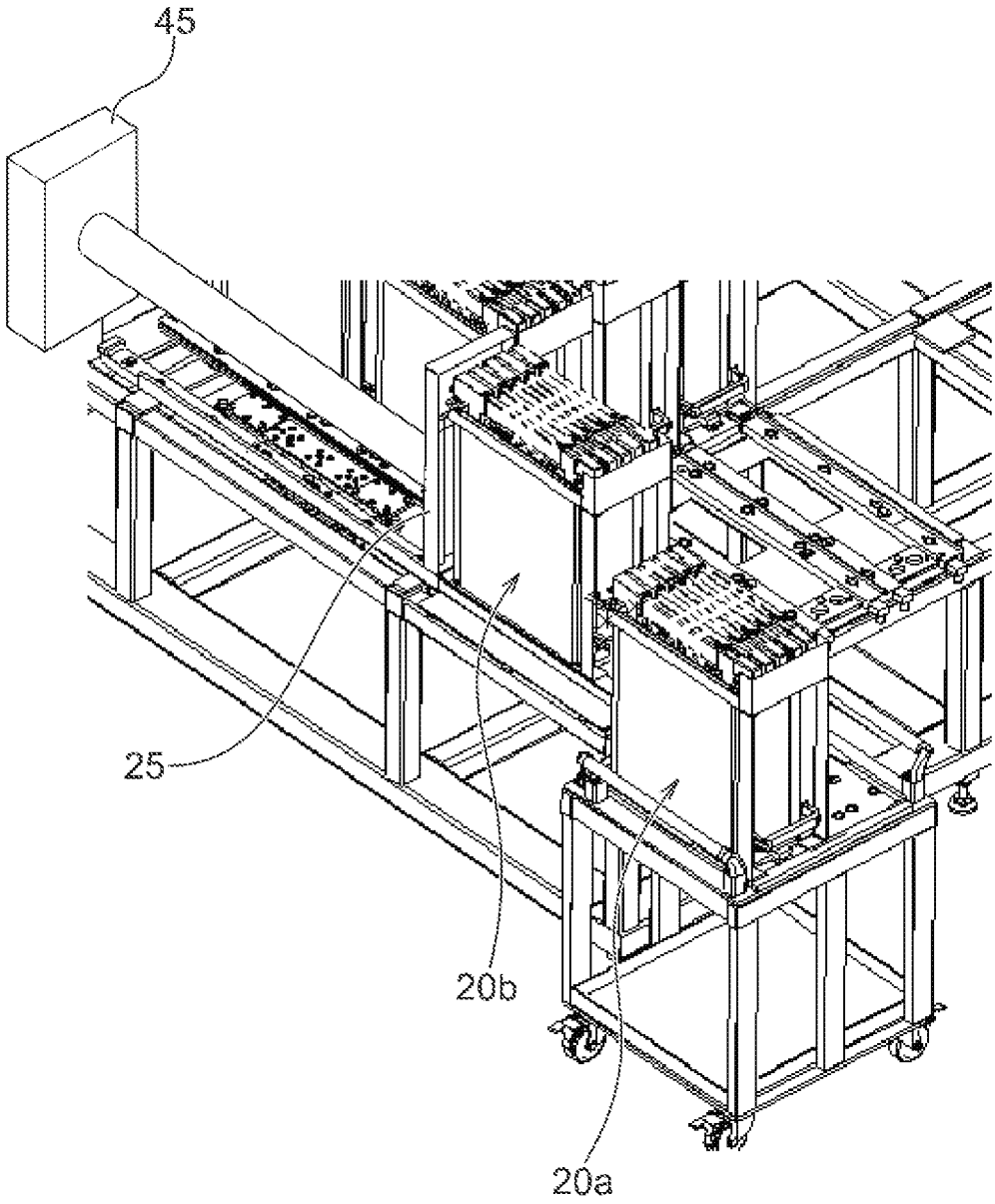
FIG. 9C is a view illustrating a process of taking stockers out of the plating apparatus.
Figure 9D:
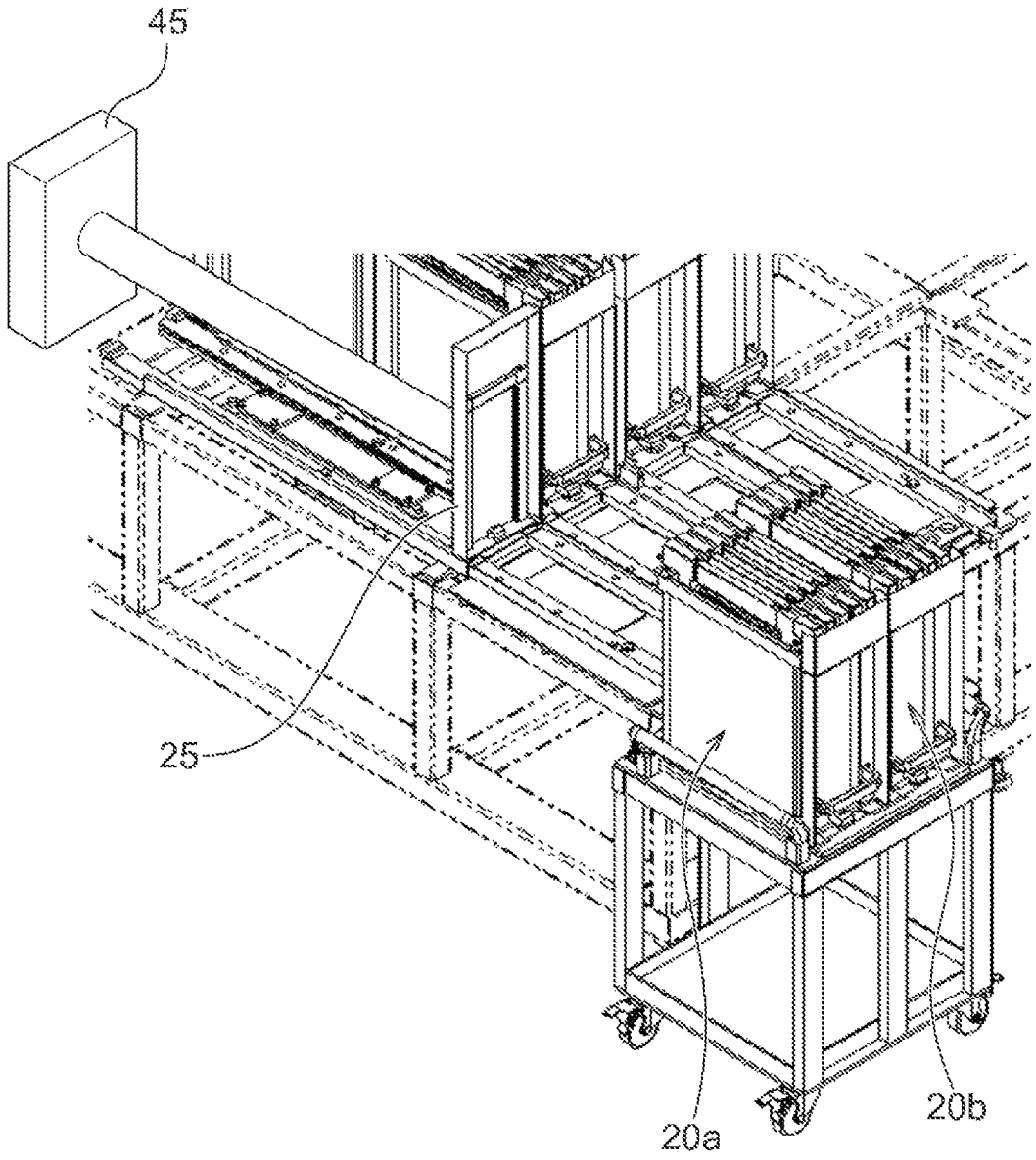
FIG. 9D is a view illustrating a process of taking stockers out of the plating apparatus.

Then, as illustrated in FIG. 9C, the stocker moving device 45 further pushes the rear partition wall 25 to position the connected stocker 20*b* out of the opening portion 21. In this state, the connection between the stocker 20*b* and the rear partition wall 25 is released, and the stocker 20*b* is placed on the cart 44 as illustrated in FIG. 9D. In this way, the stockers 20*a* and 20*b* are taken out of the plating apparatus. Note that at this time, as illustrated in FIG. 9D, an unillustrated stopper 37 prevents the rear partition wall 25 from going out of the opening portion 21 and at least a part of the opening portion 21 is covered with the rear partition wall 25. Thus, the operator can be prevented from entering the plating apparatus through the opening portion 21.

Figure 10:
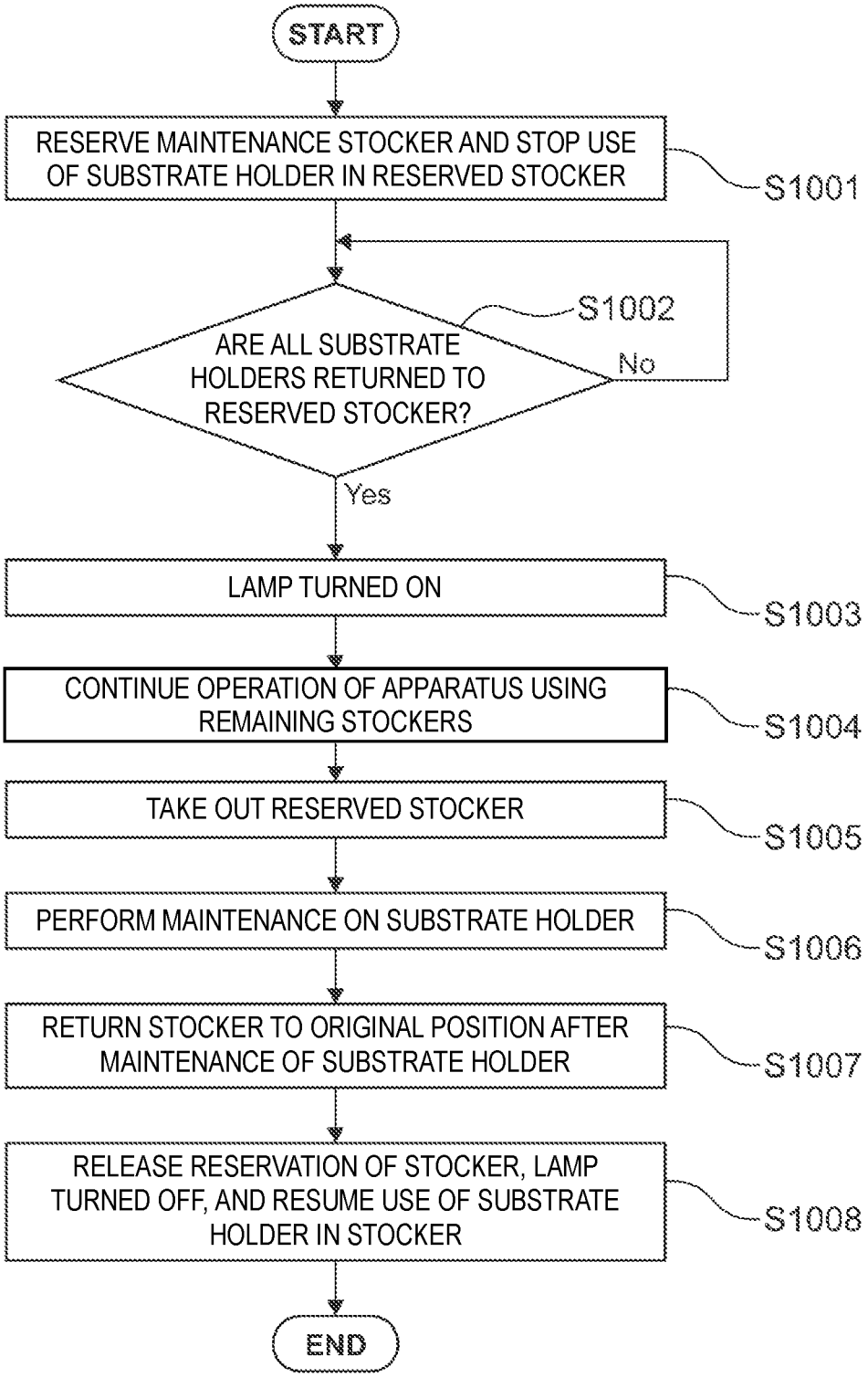
FIG. 10 is a flowchart illustrating an example of takeout/storage control flow of a stocker in the plating apparatus.

Then, the description will move on to the takeout/storage control of the stocker 20. FIG. 10 is a flowchart illustrating an example of takeout/storage control flow of the stocker 20 in the plating apparatus according to the present embodiment. The plating apparatus of the present embodiment can select a stocker 20 to be maintained from among a plurality of stockers 20.

First, the control unit 175C of the plating apparatus makes a takeout reservation on at least one stocker 20 (referred to as a maintenance stocker) storing the substrate holder 11 to be maintained from a plurality of stockers 20 (Step S1001). As used herein, the takeout reservation refers to an operation performed by the control unit 175C to select at least one stocker 20 as a target to be taken out of a plurality of stockers 20. More specifically, for example, when the operator selects a stocker 20 by operating the controller 175 of the plating apparatus, a takeout reservation is made on the stocker 20. In the present description, the stocker subjected to takeout reservation is referred to as a reserved stocker. Note that as described above, an anode holder subjected to maintenance can also be stored in the stocker 20. The control unit 175C stops the use of the substrate holder 11 corresponding to the reserved stocker, namely, the substrate holder 11 to be stored in the reserved stocker, and controls the substrate holder transport device 140 so as to return the substrate holder 11 into the reserved stocker (Step S1001).

The control unit 175C determines whether or not all the substrate holders 11 to be stored in the reserved stocker are returned to the reserved stocker (Step S1002). If it is determined that all the substrate holders 11 are returned to the reserved stocker (Step S1002: Yes), the control unit 175C turns on, for example, an unillustrated lamp provided in the controller 175 (Step S1003). The lighting of the lamp indicates that the reserved stocker may be taken out of the plating apparatus. Note that not all the substrate holders 11 corresponding to the reserved stocker but at least some of the substrate holders 11 needing maintenance may be returned to the reserved stocker.

The control unit 175C continues the operation of the plating apparatus using the remaining stockers 20 other than the reserved stocker (Step S1004). More specifically, the control unit 175C controls the treatment section 170B (see FIG. 1) and the substrate holder transport device 140 to perform a plating process on the substrate W using the substrate holder 11 to be stored in the stocker 20 other than the reserved stocker. Meanwhile, the reserved stocker is taken out of the plating apparatus (Step S1005). At this time, the stocker moving device 45 may be used to automatically take the reserved stocker out of the plating apparatus as illustrated in FIGS. 9A to 9D or the operator may manually take the reserved stocker out of the plating apparatus.

Then, maintenance is performed on the substrate holder 11 stored in the reserved stocker taken out of the plating apparatus (Step S1006). When the maintenance of the substrate holder 11 is completed, the substrate holder 11 is returned to the plating apparatus in a state of being stored in the reserved stocker (Step S1007). When the reserved stocker is returned to the plating apparatus, the reserved stocker is detected by the stocker sensor 38 illustrated in FIGS. 7 and 8, the position sensor 41 detects that the reserved stocker is fixed by the fixing pin 39, the control unit 175C releases the takeout reservation of the reserved stocker. When the takeout reservation is released, the control unit 175C turns off the unillustrated lamp, and resume the plating process using the substrate holder 11 to be stored in all the stockers 20 (Step S1008).

In the plating apparatus of the present embodiment, when an error occurs in the substrate holder 11 or an anode holder or when a periodical maintenance time has come, the use of the holder needs to be stopped and the holder needs to be maintained. According to the process flow illustrated in FIG. 10, for example, by making a takeout reservation on the stocker 20 expected to store a holder needing its use to be stopped, the substrate holder 11 or the anode holder needing the use to be stopped can be stored in the stocker 20 and taken out of the plating apparatus. In addition, according to the present embodiment, the plating process is performed using a holder to be stored in a stocker 20 other than the stocker 20 subjected to takeout reservation, and thus the operation can be continued while the stocker 20 is being taken out of the plating apparatus.

In addition, according to the process flow illustrated in FIG. 10, when the taken out stocker 20 is returned to the plating apparatus, the plating process can be performed using the substrate holder 11 to be stored in all the stockers 20 including this taken out stocker 20. Thus, after the stocker 20 is returned to the plating apparatus, the plating process is performed using all the substrate holders 11 in the same way as normal. Thus, this embodiment can prevent reduction in the amount of production of the plating apparatus. Note that in the process flow illustrated in FIG. 10, the reserved stocker is taken out and maintained, and then the reserved stocker is returned to the plating apparatus. However, without being limited to this, an extra stocker 20 storing an extra substrate holder 11 is prepared and immediately after the reserved stocker is taken out, the extra stocker 20 may be stored in the plating apparatus. This embodiment can perform a plating process using the extra substrate holder 11 during maintenance of the substrate holder 11, and can prevent reduction in the amount of production of the plating apparatus during maintenance.

Figure 11:
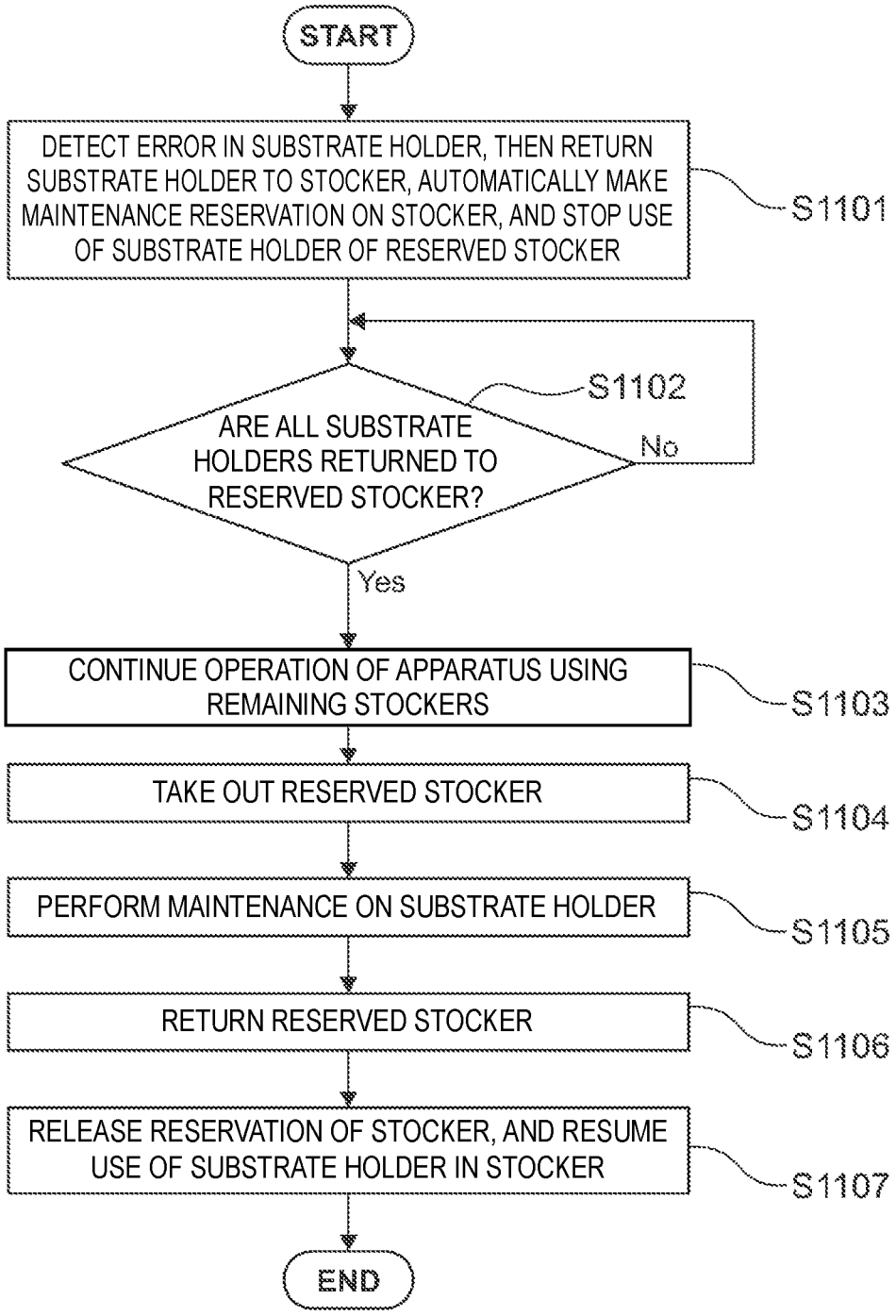
FIG. 11 is a flowchart illustrating another example of takeout/storage control flow of a stocker in the plating apparatus.

Then, the description will move on to the takeout/storage control of the stocker 20 when an error occurs in the substrate holder 11 or an anode holder. FIG. 11 is a flowchart illustrating another example of the takeout/storage control flow of the stocker 20 in the plating apparatus of the present embodiment. The plating apparatus of the present embodiment can take the stocker 20 to store the substrate holder 11 or the anode holder in which the error occurred, out of the plating apparatus. For the sake of convenience, in FIG. 11, the description will focus on the takeout/storage control of the stocker 20 when an error occurs in the substrate holder 11.

First, the control unit 175C of the controller 175 detects an error in the substrate holder 11 (Step S1101). More specifically, for example, when the substrate W is attached to the substrate holder 11 in the substrate attaching/detaching section 120, conduction confirmation is performed to detect whether or not the substrate W is conducted. Alternatively, it can be detected that an error occurs in a seal to the peripheral end portion of the substrate W in the substrate holder 11 or it can be detected that a plating solution enters the seal by the change in electric resistance value by monitoring the electric resistance at the time of plating. A well-known method can be adopted as a means of detecting such an error of the substrate holder 11. When a signal indicating that an error occurred in the substrate holder 11 is received from each section of the plating apparatus, the control unit 175C controls the substrate holder transport device 140 to return the substrate holder 11 to the stocker 20 corresponding to the substrate holder 11 in which the error occurred or to the stocker 20 expected to store the substrate holder 11 in which the error occurred (Step S1101). At this time, only the substrate holder 11 in which the error occurred may be returned to the stocker 20 or all the substrate holders 11 including the substrate holder 11 in which the error occurred may be returned to the stocker 20. Then, the control unit 175C stops the use of the stocker 20 expected to store the substrate holder 11 in which the error occurred, and automatically make a takeout reservation (Step S1101).

The control unit 175C determines whether or not all the substrate holders 11 to be stored in the reserved stocker are returned to the reserved stocker (Step S1102). Note that in step S1102, the control unit 175C may determine whether or not at least some of the substrate holders 11 in which the error occurred are returned to the reserved stocker. If it is determined that all the substrate holders 11 or at least some of the substrate holders 11 in which the error occurred are returned to the reserved stocker (S1102: Yes), the control unit 175C continues the operation of the plating apparatus using the remaining stockers 20 other than the reserved stocker (Step S1103). More specifically, the control unit 175C controls the treatment section 170B (see FIG. 1) and the substrate holder transport device 140 to perform a plating process on the substrate W using the substrate holder 11 to be stored in the stocker 20 other than the reserved stocker. Meanwhile, the reserved stocker is taken out of the plating apparatus (Step S1104). At this time, the stocker moving device 45 or the like may be used to automatically take the reserved stocker out of the plating apparatus as illustrated in FIGS. 9A to 9D. Alternatively, the operator may manually take the reserved stocker out of the plating apparatus. In this case, from the viewpoint of safety of the operator, the lamp as described in FIG. 10 is preferably turned on to notify the operator that the operator can take out the reserved stocker.

Then, maintenance is performed on the substrate holder 11 stored in the reserved stocker taken out of the plating apparatus (Step S1105). When the maintenance of the substrate holder 11 is completed, the substrate holder 11 is returned to the plating apparatus in a state of being stored in the reserved stocker (Step S1106). When the reserved stocker is returned to the plating apparatus, the reserved stocker is detected by the stocker sensor 38 illustrated in FIGS. 7 and 8, the position sensor 41 detects that the reserved stocker is fixed by the fixing pin 39, the control unit 175C releases the takeout reservation of the reserved stocker (Step S1107). When the takeout reservation is released, the control unit 175C resumes the plating process using the substrate holder 11 to be stored in all the stockers 20 (Step S1107).

According to the process flow illustrated in FIG. 11, when an error occurs in the substrate holder 11, a takeout reservation is made on the stocker 20 expected to store the substrate holder 11 in which the error occurred, and thus the substrate holder 11 in which the error occurred can be stored in the stocker 20 and can be taken out of the plating apparatus. The present embodiment performs a plating process using a holder to be stored in the stocker 20 other than the stocker 20 on which the takeout reservation was made, and thus can continue operation while the stocker 20 is being taken out of the plating apparatus.

According to the process flow illustrated in FIG. 11, when the taken out stocker 20 is returned to the plating apparatus, the plating process can be performed using the substrate holder 11 to be stored in all the stockers 20 including this taken out stocker 20. Thus, after the stocker 20 is returned to the plating apparatus, the plating process is performed using all the substrate holders 11 in the same way as normal. Thus, this embodiment can prevent reduction in the amount of production of the plating apparatus. Note that in the process flow illustrated in FIG. 11, the reserved stocker is taken out and maintained, and then the reserved stocker is returned to the plating apparatus. However, without being limited to this, an extra stocker 20 storing an extra substrate holder 11 is prepared and immediately after the reserved stocker is taken out, the extra stocker 20 may be stored in the plating apparatus. This embodiment can perform a plating process using the extra substrate holder 11 during maintenance of the substrate holder 11, and can prevent reduction in the amount of production of the plating apparatus during maintenance.

Figure 12:
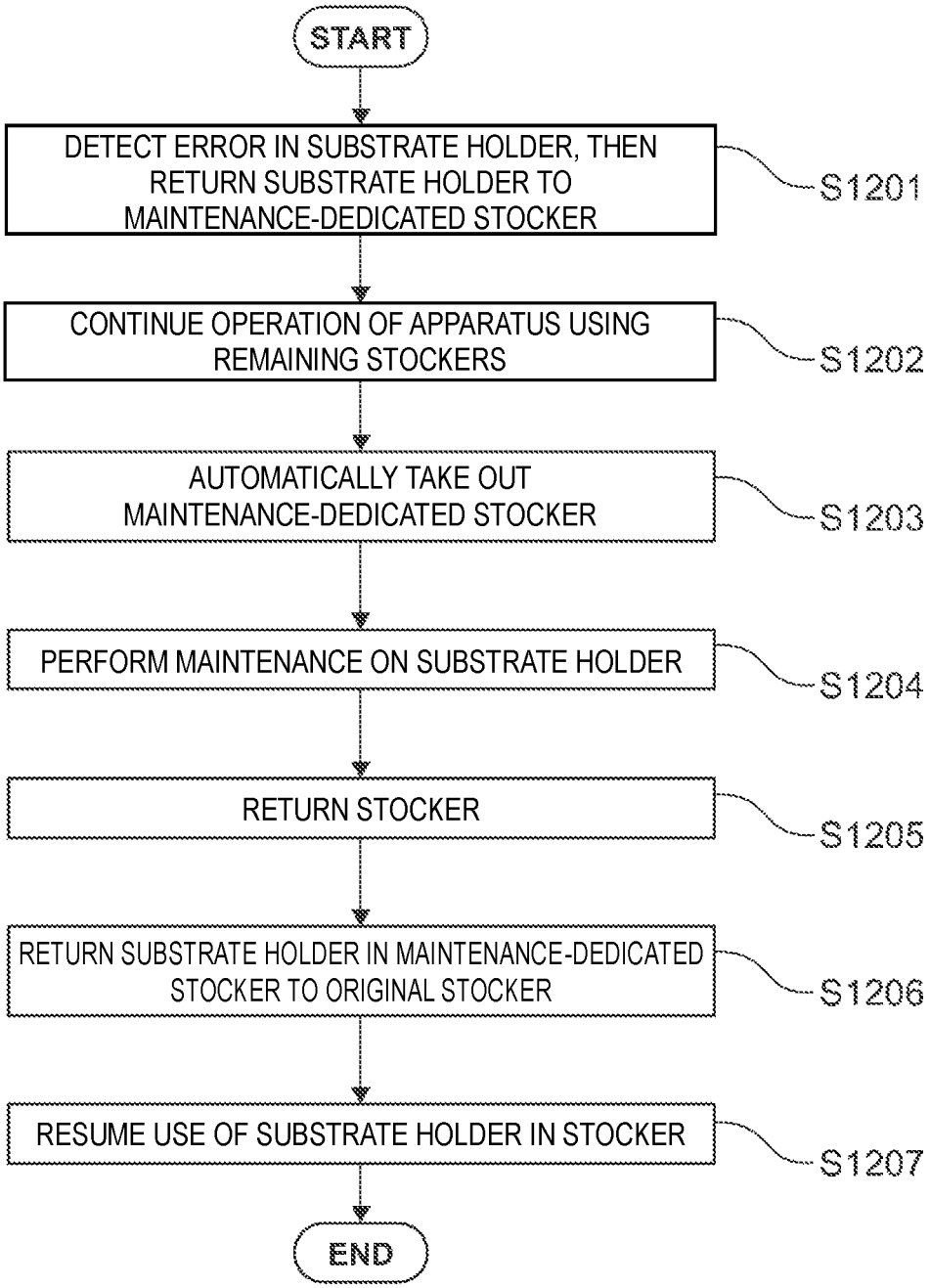
FIG. 12 is a flowchart illustrating still another example of takeout/storage control flow of a stocker in the plating apparatus.

Next, the description will focus on the takeout/storage control of the stocker 20 when the plating apparatus includes a maintenance-dedicated stocker 20. The plating apparatus does not use at least one of the plurality of stockers 20 at a normal plating process, but may use the stocker as a stocker 20 (referred to as a maintenance-dedicated stocker) to store only the substrate holder 11 or the anode holder needing maintenance. FIG. 12 is a flowchart illustrating yet another example of the takeout/storage control flow of the stocker 20 in the plating apparatus of the present embodiment. In the plating apparatus of the present embodiment, the substrate holder 11 or the anode holder in which an error occurred can be stored in a maintenance-dedicated stocker, and the maintenance-dedicated stocker can be taken out of the plating apparatus. For the sake of convenience, in FIG. 12, the description will focus on the takeout/storage control of the maintenance-dedicated stocker when an error occurs in the substrate holder 11.

First, the control unit 175C of the controller 175 detects an error in the substrate holder 11 (Step S1201). More specifically, for example, when the substrate W is attached to the substrate holder 11 in the substrate attaching/detaching section 120, conduction confirmation is performed to detect whether or not the substrate W is conducted. Alternatively, it can be detected that an error occurs in a seal to the peripheral end portion of the substrate W in the substrate holder 11 or it can be detected that a plating solution enters the seal by the change in electric resistance value by monitoring the electric resistance at the time of plating. A well-known method can be adopted as a means of detecting such an error of the substrate holder 11. When a signal indicating that an error occurred in the substrate holder 11 is received from each section of the plating apparatus, the control unit 175C controls the substrate holder transport device 140 to return the substrate holder 11 to the maintenance-dedicated stocker (Step S1201). Note that the maintenance-dedicated stocker is a stocker 20 which has been preliminarily selected as the takeout target by the control unit 175C.

The control unit 175C continues the operation of the plating apparatus using the remaining stockers 20 other than the maintenance-dedicated stocker (Step S1202). More specifically, the control unit 175C controls the treatment section 170B (see FIG. 1) and the substrate holder transport device 140 to perform a plating process on the substrate W using the substrate holder 11 to be stored in the stocker 20 other than the maintenance-dedicated stocker. In other words, the control unit 175C performs a plating process using all the substrate holders other than the substrate holder 11 in which the error occurred.

Meanwhile, the maintenance-dedicated stocker is taken out of the plating apparatus (Step S1203). At this time, the stocker moving device 45 or the like may be used to automatically take the reserved stocker out of the plating apparatus as illustrated in FIGS. 9A to 9D. Alternatively, the operator may manually take the reserved stocker out of the plating apparatus. In this case, from the viewpoint of safety of the operator, the lamp as described in FIG. 10 is preferably turned on to notify the operator that the operator may take out the reserved stocker. Note that the process flow illustrated in FIG. 12 does not have the process of determining whether or not the substrate holder 11 is returned to the stocker 20 (Step S1002 and Step S1102) illustrated in FIGS. 10 and 11 respectively. The reason for this is that in the process flow illustrated in FIG. 12, when it is detected that an error occurred in the substrate holder 11, only the substrate holder 11 is immediately returned to the maintenance-dedicated stocker, and thus such a determination process is not needed. However, such a determination process may be performed.

Then, maintenance is performed on the substrate holder 11 stored in the maintenance-dedicated stocker taken out of the plating apparatus (Step S1204). When the maintenance of the substrate holder 11 is completed, the substrate holder 11 is returned to the plating apparatus in a state of being stored in the maintenance-dedicated stocker (Step S1205). When the maintenance-dedicated stocker is returned to the plating apparatus, the maintenance-dedicated stocker is detected by the stocker sensor 38 illustrated in FIGS. 7 and 8, the position sensor 41 detects that the maintenance-dedicated stocker is fixed by the fixing pin 39, the control unit 175C controls the substrate holder transport device 140 to return the substrate holder 11 in the maintenance-dedicated stocker to the original stocker 20 (Step S1206). When the substrate holder 11 is returned to the original stocker 20, the control unit 175C resumes the plating process using the substrate holder 11 to be stored in all the stockers 20 (Step S1207).

According to the process flow illustrated in FIG. 12, the substrate holder 11 or the anode holder in which the error occurred is stored in the maintenance-dedicated stocker. Therefore, even if the maintenance-dedicated stocker is moved out of the plating apparatus for maintenance, the number of stockers 20 for use in the normal plating process is unchanged. Thus, this embodiment can maintain the number of usable stockers 20 even during maintenance and thus can suppress reduction in the amount of production of the plating apparatus.

As described above, the plating apparatus according to the first embodiment includes a plurality of stockers 20 and at least one of the stockers 20 can be taken out of the plating apparatus. Thus, the stocker 20 storing the substrate holder 11 or the anode holder requiring maintenance can be taken out of the plating apparatus and maintenance can be performed on the substrate holder 11 or the anode holder. In addition, during maintenance, another stocker 20 is in a state of being disposed in the plating apparatus. Thus, the first embodiment enables continuous operation of the plating apparatus even while the substrate holder 11 or the anode holder is in maintenance, and thus can increase the amount of production as compared with the conventional case where the plating apparatus is stopped. It has been found that some of the substrate holders 11 and anode holders have no structural defect in the folder itself, but having a difference in the number of errors occurring in the plating process as the plating process continues, namely, some of the substrate holders 11 or the anode holders with a large number of errors and others of the substrate holders 11 or the anode holders with a small number of errors. The first embodiment provides a plurality of stockers 20 in the plating apparatus. For example, the substrate holders 11 or the anode holders with a history of errors are stored in a first stocker 20 and the other holders are stored in a second stocker 20, whereby the first stocker 20 can be selected as the maintenance target and can be moved out of the plating apparatus. Further, the first embodiment provides a plurality of stockers 20 in the plating apparatus. For example, the substrate holder 11 for holding the substrate W with a first specification can be stored in the first stocker 20, and the other substrate holders 11 can be stored in the second stocker 20. Thus, even if substrates W with different specifications are simultaneously or continuously transported to the plating apparatus, the plating process can be continued without stopping the apparatus. As a result, the plating process can be performed on the substrates W with different specifications without reducing the throughput per unit time of the entire apparatus.

Second Embodiment

Figure 13:
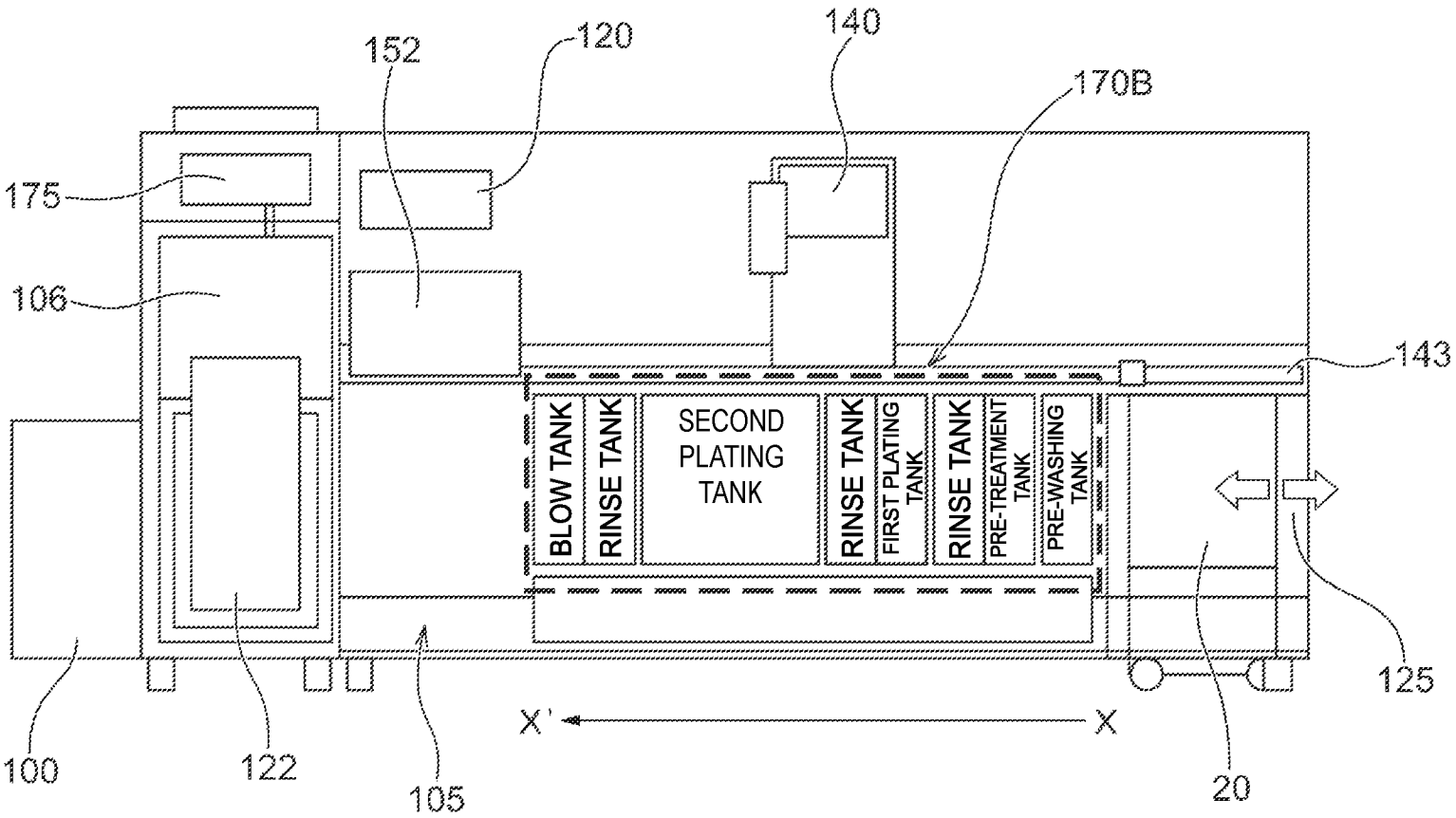
FIG. 13 is an overall side view of a plating apparatus according to a second embodiment.

Hereinafter, the second embodiment of the present invention will be described with reference to the accompanying drawings. FIG. 13 is an overall side view of a plating apparatus according to the second embodiment. The specific configuration and function of each section of the plating apparatus according to the second embodiment is the same as those of the first embodiment except the arrangement of each section. More specifically, the plating apparatus according to the second embodiment includes a stocker 20 having the specific configuration and function of the stocker 20 illustrated in FIGS. 3 to 9 and can perform the takeout/storage control of the stocker 20 described in FIGS. 10 to 12.

As illustrated in FIG. 13, the plating apparatus includes a cassette 100 having a substrate W stored in a plating apparatus frame 105, a substrate transport device 122, a spin rinse dryer 106, a substrate attaching/detaching section 120, a placement plate 152, a treatment section 170B, a substrate holder transport device 140 movable along the traveling shaft 143, a plurality of stockers 20, a stocker installation section 125, and an unillustrated aligner. Note that FIG. 13 illustrates only one of the plurality of stockers 20.

In this example, the treatment section 170B includes a blow bath, a rinse bath, a second plating bath, a rinse bath, a first plating bath, a rinse bath, a pre-treatment bath, and a pre-washing bath in this order from the cassette 100 side. The second embodiment is not limited to this, but may include the treatment section 170B having the same configuration as that of the plating apparatus of the first embodiment or another treatment section 170B having a different configuration. In other words, the type of bath, the number of baths, and the arrangement of the baths of the treatment section 170B can be freely selected according to the treatment purpose of the substrate W. Note that each bath is preferably arranged in the order in the direction from X to X' illustrated in the Figure according to the order of the steps to shorten the transport path of the substrate holder 11.

The plating apparatus of the second embodiment is greatly different from that of the first embodiment in that a plurality of stockers 20 is arranged at a rear stage of the plating apparatus. Even if the plating apparatus is configured in this way, at least one of the plurality of stockers 20 can be independently moved into and out of the plating apparatus.

Hereinbefore, the embodiments of the present invention have been described. The above described embodiments of the invention are provided to facilitate the understanding of the present invention and are not intended to limit the present invention. It is apparent that the present invention may be changed or improved without departing from the spirit of the invention and such equivalents are included in the present invention. Further, the individual components described in the claims and the specification may be appropriately combined or omitted within a range in which at least some of the above described problems can be solved or within a range in which at least some of the effects can be exhibited.

REFERENCE SIGNS LIST

10 plating bath
11 substrate holder

18 paddle
19 paddle drive device
20 stocker
21 opening portion
23 rail
25 rear partition wall
27 partition wall
27*a* partition wall member
29*a* locking part
29*b* locked part
35 sliding body
36 support surface
37 stopper
38 stocker sensor
39 fixing pin
40 obstacle sensor
45 stocker moving device
114 power supply contact
122 substrate transport device
125 stocker installation section
140 substrate holder transport device
175 controller

What is claimed is:

1. A plating apparatus comprising:

a plating treatment section performing plating on a substrate; and a plurality of stockers configured to be able to store a holder configured to hold a substrate or an anode, wherein each of the plurality of stockers is configured to be movable into and out of the plating apparatus, and one or more of the plurality of stockers is located in the plating apparatus when at least one of the plurality of stockers is moved out of the plating apparatus, the plating apparatus further comprising, an opening portion for taking the at least one of the plurality of stockers out of the plating apparatus, wherein the at least one of the plurality of stockers has a partition wall on a side surface thereof, the partition wall covering at least a part of the opening portion so as to partition an inside of the plating apparatus and an outside of the plating apparatus, and the partition wall positioned such that the partition wall covers the at least a part of the opening portion when the at least one of the plurality of stockers is fixed inside the plating apparatus, the plating apparatus comprises a rear partition wall disposed on an opposite side of the partition wall with the at least one of the plurality of stockers interposed therebetween and configured to cover the at least a part of the opening portion, the rear partition wall is configured to be movable with the at least one of the plurality of stockers, and the plating apparatus comprises a stopper configured to stop the rear partition wall at a position where the rear partition wall covers the at least a part of the opening portion.

2. The plating apparatus according to claim 1, comprising a guide member for guiding the stocker into and out of the plating apparatus.

3. The plating apparatus according to claim 2, wherein the guide member comprises a sliding body slidably supporting the stocker.

4. The plating apparatus according to claim 1, comprising a fixing member for fixing the stocker disposed in the plating apparatus.

5. The plating apparatus according to claim 1, comprising a stocker sensor detecting whether or not the stocker is present at a predetermined position inside the plating apparatus.

6. The plating apparatus according to claim 1, comprising an obstacle sensor detecting whether or not an obstacle is present in the opening portion.

7. The plating apparatus according to claim 1, wherein the stocker comprises a connecting portion configured to detachably connect the stocker to another stocker adjacent in a moving direction of the stocker.

8. The plating apparatus according to claim 1, comprising a support surface slidably supporting the stocker.

9. The plating apparatus according to claim 1, comprising a transport device configured to transport the holder; and a control unit, wherein the control unit is configured to select at least one of the plurality of stockers, and instruct the transport device to store the holder in the selected stocker.

10. The plating apparatus according to claim 1, comprising a transport device configured to transport the holder; and a control unit, wherein the control unit is configured to receive a signal indicating that an error occurred in the holder, select a stocker to store the holder in which the error occurred when the signal is received, and instruct the transport device to return at least the holder in which the error occurred to the selected stocker.

11. The plating apparatus according to claim 9, wherein the control unit is configured to control the plating treatment section and the transport device to perform plating on the substrate using the holder to be stored in a stocker other than the selected stocker.

12. The plating apparatus according to claim 9, wherein the control unit is configured to determine whether or not the taken out stocker or a stocker different from the stocker is stored in the plating apparatus after the selected stocker is taken out of the plating apparatus, and control the plating treatment section and the transport device to perform plating on the substrate using the holder to be stored in all the stockers when the taken out stocker or a stocker different from the stocker is stored in the plating apparatus.

13. The plating apparatus according to claim 10, wherein the plurality of stockers comprises a maintenance-dedicated stocker to store a holder to be maintained, and the stocker to store the holder in which the error occurred is the maintenance-dedicated stocker.

14. The plating apparatus according to claim 9, comprising a moving device moving the stocker out of the plating apparatus, wherein the control unit is configured to determine whether or not the holder expected to be stored in the selected stocker is returned to the stocker and when the holder is returned to the selected stocker, control the moving device to take the selected stocker out of the plating apparatus.

15. The plating apparatus according to claim 14, the moving device is configured to move the stocker into the plating apparatus.

* * * * *